US011051660B2

(12) United States Patent
Lindstrom et al.

(10) Patent No.: US 11,051,660 B2
(45) Date of Patent: Jul. 6, 2021

(54) PLASTOMER SPRING WITH CAPTIVE VALVE

(71) Applicant: Essity Hygiene and Health Aktiebolag, Gothenburg (SE)

(72) Inventors: Hakan Lindstrom, Gothenburg (SE); Peter Bergman, Gothenburg (SE); Hugo Nilsson, Ljungby (SE)

(73) Assignee: Essity Hygiene and Health Aktiebolag, Gothenburg (SE)

( * ) Notice: Subject to any disclaimer, the term of this patent is extended or adjusted under 35 U.S.C. 154(b) by 0 days.

(21) Appl. No.: 16/497,164

(22) PCT Filed: Mar. 29, 2017

(86) PCT No.: PCT/EP2017/057411
§ 371 (c)(1),
(2) Date: Sep. 24, 2019

(87) PCT Pub. No.: WO2018/177519
PCT Pub. Date: Oct. 4, 2018

(65) Prior Publication Data

US 2020/0046173 A1 Feb. 13, 2020

(51) Int. Cl.
*A47K 5/12* (2006.01)
*B05B 11/00* (2006.01)

(52) U.S. Cl.
CPC ..... *A47K 5/1207* (2013.01); *B05B 11/0054* (2013.01); *B05B 11/00412* (2018.08);
(Continued)

(58) Field of Classification Search
CPC ..... A47K 5/1207; B05B 11/0054; B05B 11/00412; B05B 11/3029; B05B 11/3033;
(Continued)

(56) References Cited

U.S. PATENT DOCUMENTS 1,687,317 A 10/1928 Archer
2,654,597 A 10/1953 Barenyi
(Continued)

FOREIGN PATENT DOCUMENTS

AU 658398 B2 4/1995
CA 2117205 A1 9/1995
(Continued)

OTHER PUBLICATIONS

European Patent Office, International Search Report and Written Opinion of the International Searching Authority, International Application No. PCT/EP2017/057411, dated Dec. 7, 2017 (15 pages).
(Continued)

*Primary Examiner* — Vishal Pancholi
*Assistant Examiner* — Bob Zadeh
(74) *Attorney, Agent, or Firm* — Wood Herron & Evans LLP

(57) ABSTRACT

The disclosure relates to a fluid pump including a plastomer spring with a captive valve element provided in an integrally formed valve chamber. The spring includes a first end portion and a second end portion and one or more spring sections connecting the first end portion to the second end portion, which spring sections can be compressed in the axial direction from an initial condition to a compressed condition and can subsequently expand to their initial condition. The valve chamber is formed in the first end portion.

49 Claims, 15 Drawing Sheets

(52) U.S. Cl.
CPC ..... *B05B 11/3029* (2013.01); *B05B 11/3033* (2013.01); *B05B 11/3064* (2013.01); *B05B 11/3077* (2013.01)

(58) Field of Classification Search
CPC ..... B05B 11/3064; B05B 11/3077; B05B 11/3035
See application file for complete search history.

(56) References Cited

U.S. PATENT DOCUMENTS

| | | | | |
|---|---|---|---|---|
| 3,141,580 | A | 7/1964 | Rogers | |
| 3,190,632 | A | 6/1965 | Barenyi | |
| 3,359,917 | A | 12/1967 | Cooprider | |
| 3,602,387 | A | 8/1971 | Patnaude et al. | |
| 3,672,114 | A * | 6/1972 | Sacks | F04B 45/02 53/88 |
| 4,120,429 | A * | 10/1978 | Vignot | F16B 7/02 222/207 |
| 4,212,408 | A | 7/1980 | Valenzona | |
| 4,330,071 | A | 5/1982 | Ohlson | |
| 4,512,501 | A | 4/1985 | Foster | |
| 4,572,117 | A | 2/1986 | Yoshikawa | |
| 4,598,820 | A | 7/1986 | Murphy | |
| 4,753,423 | A | 6/1988 | Ukai et al. | |
| 4,863,070 | A * | 9/1989 | Andris | G01F 11/08 222/207 |
| 4,872,596 | A | 10/1989 | Corsette | |
| 5,114,052 | A | 5/1992 | Tiramani et al. | |
| 5,303,867 | A | 4/1994 | Peterson | |
| 5,435,195 | A | 7/1995 | Meier | |
| 5,462,208 | A | 10/1995 | Stahley et al. | |
| 5,476,195 | A | 12/1995 | Oder et al. | |
| 5,651,480 | A * | 7/1997 | Piepenstock | B05B 11/3077 222/321.9 |
| 5,664,703 | A | 9/1997 | Reifenberger et al. | |
| 5,979,711 | A * | 11/1999 | Fuchs | B05B 11/0005 222/321.2 |
| 6,227,240 | B1 | 5/2001 | Wu et al. | |
| 6,718,575 | B1 | 4/2004 | Lubeck et al. | |
| 6,811,298 | B2 | 11/2004 | Penaranda et al. | |
| 7,861,895 | B2 | 1/2011 | Ray | |
| 7,867,204 | B2 | 1/2011 | Bartholomew et al. | |
| 7,984,728 | B2 | 7/2011 | Wynn, Jr. | |
| 7,987,738 | B2 | 8/2011 | Kaps et al. | |
| 8,011,901 | B2 | 9/2011 | Duncan | |
| 8,220,666 | B2 | 7/2012 | Abe | |
| 8,267,284 | B2 | 9/2012 | Ray | |
| 8,591,207 | B2 | 11/2013 | Ciavarella | |
| 8,763,863 | B2 | 7/2014 | Quinlan et al. | |
| 8,827,119 | B2 | 9/2014 | Ciavarella et al. | |
| 10,213,062 | B2 * | 2/2019 | Nilsson | B05B 11/3033 |
| 10,543,500 | B2 * | 1/2020 | Nilsson | B05B 11/3035 |
| 2002/0139816 | A1 | 10/2002 | Powling | |
| 2004/0159976 | A1 * | 8/2004 | Sueoka | F16D 3/845 264/267 |
| 2007/0194054 | A1 | 8/2007 | Ganzeboom et al. | |
| 2008/0029556 | A1 | 2/2008 | Chen | |
| 2008/0319119 | A1 * | 12/2008 | Waddell | B60C 1/0025 524/445 |
| 2009/0071977 | A1 | 3/2009 | Abe | |
| 2009/0188994 | A1 | 7/2009 | Ray et al. | |
| 2010/0059550 | A1 | 3/2010 | Ciavarella et al. | |
| 2012/0104048 | A1 | 5/2012 | Tseng | |
| 2012/0141309 | A1 | 6/2012 | Ciavarella | |
| 2012/0308405 | A1 | 12/2012 | McNulty et al. | |
| 2013/0175301 | A1 | 7/2013 | Ray | |
| 2013/0292419 | A1 | 11/2013 | Quinlan et al. | |
| 2014/0117053 | A1 | 5/2014 | Ciavarella et al. | |
| 2014/0158715 | A1 | 6/2014 | Wells | |
| 2014/0197196 | A1 | 7/2014 | Tederous et al. | |
| 2014/0205473 | A1 | 7/2014 | Ciavarella et al. | |
| 2014/0261799 | A1 | 9/2014 | Ciavarella et al. | |
| 2014/0263462 | A1 | 9/2014 | Quinlan et al. | |
| 2014/0364556 | A1 * | 12/2014 | Issel | C08L 33/12 524/507 |
| 2018/0264495 | A1 | 9/2018 | Micnerski | |
| 2018/0281004 | A1 | 10/2018 | Nilsson et al. | |
| 2019/0076864 | A1 | 3/2019 | Nilsson et al. | |
| 2020/0046173 | A1 * | 2/2020 | Lindstrom | B05B 11/0054 |

FOREIGN PATENT DOCUMENTS

| | | | |
|---|---|---|---|
| CA | 2657542 | A1 | 9/2009 |
| CA | 2669519 | A1 | 12/2009 |
| CA | 2815247 | A1 | 4/2012 |
| CA | 2844881 | A1 | 2/2013 |
| CN | 2631399 | Y | 8/2004 |
| CN | 1796248 | A | 7/2006 |
| CN | 100467257 | C | 3/2009 |
| CN | 201679964 | U | 12/2010 |
| CN | 101952178 | A | 1/2011 |
| CN | 102018466 | A | 4/2011 |
| CN | 103118797 | A | 5/2013 |
| CN | 104755122 | A | 7/2015 |
| CN | 104918711 | A | 9/2015 |
| CN | 106214036 | A | 12/2016 |
| DE | 202011052296 | U1 | 2/2012 |
| EP | 52590 | A1 | 5/1982 |
| EP | 705645 | A1 | 4/1996 |
| EP | 1243216 | A1 | 9/2002 |
| EP | 1818109 | A1 | 8/2007 |
| EP | 2446971 | A1 | 5/2012 |
| EP | 2629896 | A1 | 8/2013 |
| EP | 2669016 | A1 | 12/2013 |
| EP | 2741652 | A2 | 6/2014 |
| EP | 2743503 | A1 | 6/2014 |
| EP | 3266357 | A1 | 1/2018 |
| FR | 2969241 | A1 | 6/2012 |
| GB | 191016046 | A | 8/1910 |
| GB | 749691 | A | 5/1956 |
| GB | 893683 | A | 4/1962 |
| GB | 2109148 | A | 5/1983 |
| GB | 2125906 | A | 3/1984 |
| GB | 2329222 | A | 3/1999 |
| IT | 1132947 | B | 7/1986 |
| IT | MI120130336 | A1 | 9/2014 |
| IT | MI20130336 | U1 | 4/2015 |
| JP | H1047400 | A | 2/1998 |
| JP | H1072052 | A | 3/1998 |
| JP | 3040722 | B2 | 5/2000 |
| KR | 20150066673 | A | 6/2015 |
| RU | 2409776 | C2 | 1/2011 |
| WO | 9500252 | A1 | 1/1995 |
| WO | 9604078 | A1 | 2/1996 |
| WO | 9611064 | A1 | 4/1996 |
| WO | 9611065 | A1 | 4/1996 |
| WO | 9621387 | A1 | 7/1996 |
| WO | 9949769 | A1 | 10/1999 |
| WO | 200020294 | A1 | 4/2000 |
| WO | 0202423 | A1 | 1/2002 |
| WO | 02078502 | A1 | 10/2002 |
| WO | 200347995 | A1 | 6/2003 |
| WO | 200999537 | A1 | 8/2009 |
| WO | 2009104992 | A1 | 8/2009 |
| WO | 2009104993 | A1 | 8/2009 |
| WO | 2009104994 | A1 | 8/2009 |
| WO | 2009142886 | A1 | 11/2009 |
| WO | 2011133085 | A1 | 10/2011 |
| WO | 2012054670 | A1 | 4/2012 |
| WO | 2013009426 | A2 | 1/2013 |
| WO | 201322634 | A2 | 2/2013 |
| WO | 2013024580 | A1 | 2/2013 |
| WO | 201335316 | A1 | 3/2013 |
| WO | 2013035119 | A1 | 3/2013 |
| WO | 201355893 | A2 | 4/2013 |
| WO | 2013103670 | A1 | 7/2013 |
| WO | 2013114520 | A1 | 8/2013 |
| WO | 2013181330 | A1 | 12/2013 |
| WO | 201436067 | A1 | 3/2014 |
| WO | 201470810 | A1 | 5/2014 |
| WO | 201493261 | A1 | 6/2014 |
| WO | 2014126751 | A2 | 8/2014 |

(56) References Cited

FOREIGN PATENT DOCUMENTS

| | | | |
|---|---|---|---|
| WO | 2014167224 | A2 | 10/2014 |
| WO | 2014209288 | A1 | 12/2014 |
| WO | 201527000 | A2 | 2/2015 |
| WO | 2015106868 | A1 | 7/2015 |

OTHER PUBLICATIONS

NLO, Response to International Search Report and Written Opinion of the International Searching Authority dated Dec. 7, 2017, International Application No. PCT/EP2017/057411, dated Jan. 28, 2019 (2 pages).
European Patent Office, Second Written Opinion of the International Preliminary Examining Authority, International Application No. PCT/EP2017/057411, dated Feb. 22, 2019 (8 pages).
European Patent Office, International Preliminary Report on Patentability, International Application No. PCT/EP2017/057411, dated Jul. 9, 2019 (37 pages).
Fan Disc Corporation, Series SP Belleville Springs, retrieved from https://www.fandisc.com/disc-springs-series-sp-belleville-spring-index.html, dated 2019 (3 pages).
Dupont, Product and Properties Guide, Hytrel Polyester Elastomer, Tecspak Process, retrieved from http://www.engpolymer.co.kr/product/molding_guide/Hytrel_product_guide.pdf on Oct. 2019 (12 pages).
China National Intellectual Property Administration, Notification of the First Office Action (National Phase of PCT Application), Application No. 201580084778.8, dated Mar. 12, 2020 (14 pages).
National Intellectual Property Administration (CNIPA) of the People's Republic of China, Notification of the Third Office Action, Application No. 201580084003.0, dated Dec. 21, 2020 (9 pages).
China National Intellectual Property Administration, Notification of the First Office Action (National Phase of PCT Application), Application No. 201780087485.4, dated Sep. 8, 2020 (18 pages).
National Intellectual Property Administration (CNIPA) of the People's Republic of China, Second Office Action, Application No. 201580084003.0, dated Jun. 22, 2020 (22 pages).
Federal Service for Intellectual Property, Decision to Grant, Russian Application No. 2019134419, dated May 20, 2020 (20 pages).
New Zealand Intellectual Property Office, Patent Examination Report 2, Application No. 758544, dated Feb. 17, 2021 (5 pages).

* cited by examiner

PLASTOMER SPRING WITH CAPTIVE VALVE

CROSS-REFERENCE TO RELATED APPLICATION

The present application is a national stage entry under 35 U.S.C. § 371 of, and claims priority to, International Application No. PCT/EP2017/057411, filed Mar. 29, 2017, the disclosure of which is hereby incorporated herein by reference in its entirety.

FIELD OF THE INVENTION

The present disclosure relates to pumps of the type used for dispensing fluids and more particularly to a spring for use in a pump for dispensing skincare and cleaning products such as soaps, gels, disinfectants and the like. The disclosure is specifically directed to pumps and springs that are axially compressible and that cause dispensing by an axial reduction in volume of a pump chamber.

BACKGROUND OF THE INVENTION

Fluid dispensers of various types are known. In particular, for dispensing of cleaning products such as soaps, there are a wide variety of manually or automatically actuated pumps that dispense a given quantity of the product into a user's hand.

Consumer products may include a dispensing outlet as part of the package, actuated by a user pressing down the top of the package. Such packages use a dip tube extending below the level of the liquid and a piston pump that aspirates the liquid and dispenses it downwards through an outlet spout.

Commercial dispensers frequently use inverted disposable containers that can be placed in dispensing devices, affixed to walls or built into the counter of washrooms or the like. The pump may be integrated as part of the disposable container or may be part of the permanent dispensing device or both. Such devices are generally more robust and, if they are affixed to the wall, greater freedom is available in the direction and amount of force that is required for actuation. Such devices may also use sensors that identify the location of a user's hand and cause a unit dose of the product to be dispensed. This avoids user contact with the device and the associated cross-contamination. It also prevents incorrect operation that can lead to damage and premature ageing of the dispensing mechanism.

A characteristic of inverted dispensers is the need to prevent leakage. Since the pump outlet is located below the container, gravity will act to cause the product to escape if there is any leakage through the pump. This is particularly the case for relatively volatile products such as alcohol-based solutions. Achieving leak free operation is often associated with relatively complex and expensive pumps. For the convenience of replacing empty disposable containers however, at least part of the pump is generally also disposable and must be economical and environmentally acceptable to produce. There is therefore a need for a pump that is reliable and drip free, yet simple, economical and environmentally acceptable to produce. There is also a need to accurately define the flow characteristics of inlet and outlet check valves for such pumps. Each check valve may be required to operate under different flow and pressure conditions. In particular, for volatile or viscous liquids, the relative opening and closing pressures of the respective valves may need to be carefully matched. Manufacturing both valves from the same material in an integrated moulding procedure may limit the design options considerably. It would be desirable to provide a dispensing system having greater design freedom in relation to the inlet and outlet valves.

One disposable dispensing system that uses a pump to dispense a unit dose of liquid from an inverted collapsible container has been described in WO2009/104,992. The pump is formed of just two elements, namely a resilient pumping chamber and a regulator, having an inner valve and an outer valve. Operation of the pump occurs by application of a lateral force to the pumping chamber, causing it to partially collapse and expel its contents through the outer valve. Refilling of the pumping chamber occurs through the inner valve once the lateral force is removed. The filling force is provided by the inherent resilience of the wall of the pumping chamber, which must be sufficient to overcome any back-pressure due to a resistance to collapse of the container. Although the pump is extremely effective, the lateral force required to operate the pump can sometimes limit its integration into a dispenser body. Other dispensing systems use an axial force, i.e., directed in alignment with the direction in which the fluid is dispensed. It would be desirable to provide a pump that could operate in this manner that could also be integrated into existing axially operating dispensing solutions.

SUMMARY OF THE INVENTION

It is desirable to have a pump that may be disposable and that is desirably reliable and drip free when used, yet simple, hygienic, environmentally acceptable and economical to produce.

There is disclosed a plastomer spring for use in a fluid pump, the spring including a first end portion and a second end portion and one or more spring sections therebetween, which connect the first end portion to the second end portion and is compressible in an axial direction of the spring from an initial condition to a compressed condition, wherein the first end portion defines a valve chamber for captively receiving a moveable valve element, the valve chamber including a valve seat against which the first valve element may seal to prevent fluid flow through the valve chamber. Provision of a captive valve element introduces considerably greater design freedom in the design of this valve. The valve may be either the inlet valve or the outlet valve or both according to other aspects of the configuration. In one embodiment, it is provided as an inlet valve with flow through the valve seat past the moveable valve element into the valve chamber.

In one embodiment, the valve chamber includes a valve support element and a lid. The valve support element and the lid may seal to one another to define the valve chamber. A function of the valve support element may be to ensure correct guidance of the valve element within the valve chamber. A function of the lid may be to allow positioning of the valve element within the valve chamber during a fabrication process or to allow the spring to be integrally moulded as a single part. The valve seat may be defined around an opening through the lid. The opening may be an inlet opening to the valve chamber, which opening may be closed by the moveable valve element. Other configurations are also possible, e.g., the valve seat may be defined at an end of the valve chamber opposite to the lid and/or the opening in the lid may be configured as an outlet opening from the valve chamber.

The lid may be manufactured as a separate component from the valve support element and/or the remainder of the spring. Nevertheless, in order to reduce the number of components and facilitate assembly, or for other reasons, it may also be integrally formed with the valve chamber. This may be achieved using an integral hinge or a web or strap of plastomer material. The lid may simply close over the valve support element and be held in place by other means, e.g., gluing, welding clamping or otherwise. Alternatively, the lid and valve support element may be arranged to mechanically engage together in a snap, plug or other interference fit.

The valve element may be a free-floating element, acted upon only by gravity, fluid flow or an external field such as a magnetic field. Alternatively, it may be tethered or biased directly. It may have any appropriate form, including spherical, hemispherical, bullet shaped, disc shaped or otherwise, depending upon the form of the valve seat and the valve chamber. It may be solid, hollow or partially hollow.

In one embodiment, the spring may also include a biasing spring within the valve chamber for biasing the moveable valve element against the seat. The strength of the biasing spring may be adapted according to the nature of the fluid to be pumped and/or to the desirable response of the valve operation. The biasing spring may have any appropriate form including helical, leaf spring or the like and may be manufactured of any suitable material, including metals, rubbers and plastomers. It may also be similar in design to the spring sections.

As has been described above, there is considerable advantage in being able to manufacture a pump with a minimal number of components. This reduces the number of production steps and also reduces the number of assembly steps. Nevertheless, it can lead to increased complexity of design, making moulding tools more expensive. The choice of whether to manufacture portions of the spring valve combination integrally or separately is thus a trade-off between these two criteria. In one embodiment, the biasing spring and/or the moveable valve element may be integrally formed with the first end portion. The biasing spring and/or the moveable valve element may be moulded in position within the valve chamber or may be moulded in an exploded position and folded into the valve chamber during assembly. The biasing spring and/or the moveable valve element may also be integrally moulded and subsequently (partially) separated from each other during assembly.

Another consideration in relation to the choice of integral moulding or separate manufacture lies in the material properties of the respective components. If the spring, valve element and biasing spring are integrally moulded, this may limit them all to being of the same material. It may in certain circumstances be desirable to manufacture one of these elements from a different material. This may be the case if it is desired to make the valve element from a denser material than the spring, e.g., from metal or ceramic. Alternatively, it may be desirable to form the biasing spring to have a spring constant that is not easily achievable with the plastomer material used for the spring sections of the spring itself.

With reference to the spring and its respective spring sections, it is noted that by providing a plastomer element, operable in an axial direction in this manner, a stable spring may be obtained that does not twist or otherwise distort during compression and may be easily manufactured by injection moulding in a single piece. Unlike metal springs, by the use of polymer materials, the spring may be made compatible with multiple different cleaning fluids, without the risk of corrosion or contamination. Furthermore, recycling of the pump may be facilitated, given that other elements of the pump are also of polymer material.

The spring sections may be rhombus shaped, joined together at adjacent corners. In the present context, reference to "rhombus shaped" is not intended to limit the spring sections to the precise geometrical shape having flat sides and sharp corners. The skilled person will understand that the shape is intended to denote an injection mouldable form that will allow resilient collapse, while using the material properties of the plastomer to generate a restoring force. Furthermore, since the resiliency of the structure is at least partially provided by the material at the corner regions, these may be at least partially reinforced, curved, radiused or the like in order to optimise the required spring characteristic. In one embodiment, each spring section includes four flat leaves joined together along hinge lines that are parallel to each other and perpendicular to the axial direction. In this context, flat is intended to denote planar. The resulting configuration may also be described as concertina like.

The flat leaves may be of constant thickness over their area. The thickness may be between 0.5 mm and 1.5 mm, depending on the material used and the geometrical design of the pump and the spring. For example, a thickness between 0.7 and 1.2 mm has been found to offer excellent collapse characteristics in the case of leaves having a length between hinge lines of around 7 mm. In other words, the ratio of the thickness of the leaf to its length may be around 1:10 but may range from a ratio of 1:5 to a ratio of 1:15. The skilled person will recognise that for a given material, this ratio will be of significance in determining the spring constant of the resulting spring. In one alternative, the leaves may be thicker at their midline and may be thinned or feathered towards their edges. This feathering may be advantageous from a moulding perspective, allowing easier extraction from the mould. It also serves to concentrate the majority of the spring force to the midline. Where the spring is to be located in a cylindrical housing, this is the portion of the spring that provides the majority of the restoring force.

Additionally, as a measure to allow the spring to be installed in a cylindrical housing or pump chamber, the spring sections may have curved edges. The spring may then have a generally circular configuration, as viewed in the axial direction, i.e., it may define a cylindrical outline. It will be understood that the curved edges may be sized such that the spring is cylindrical in its unstressed initial condition or in its compressed condition or at an intermediate position between these two extremes, for example in its compressed condition.

The precise configuration of the spring will depend on the characteristics required in terms of extension and spring constant. An important factor in determining the degree of extension of the spring is the initial geometry of the rhombus shapes of the spring sections. In one embodiment, the spring sections, in their initial condition, join at adjacent corners having an internal angle $\alpha$ of between 90 and 120 degrees. In a fully relaxed spring, angle $\alpha$ may be between 60 to 160 or 100 to 130 degrees, depending on the geometries and materials used for the spring as well as the pump body. The angle $\alpha$ is normally slightly higher when the spring is inserted into the pump chamber and in its initial stage before pump compression occurs, e.g., 5-10 degrees higher than for a fully relaxed spring. For a spring in its compressed condition, the angle $\alpha$ increases towards 180 degrees and, for example, may be 160 to 180 degrees in a compressed condition. For example, the angle α may be 120 degrees for a spring in an initial condition and 160 degrees for a spring in a compressed condition.

A particularly desirable characteristic of the disclosed spring is its ability to undergo a significant reduction in length. For example, the spring sections can be arranged to compress from an open configuration to a substantially flat configuration in which the spring sections or the leaves lie close against each other, i.e., adjacent sides of the rhombus shaped spring sections become co-planar.

In a particular embodiment, each spring section may be able to compress axially to less than 60%, or less than 50% of its uncompressed length. The overall reduction in length will depend on the number of spring sections, and, in actual operation, there may be neither need nor desire to compress each spring section to the maximum. In a particular embodiment, the spring may include at least three spring sections which may be identical in geometry. A particular embodiment has five spring section, which offers a good compromise between stability and range of compression.

The skilled person will be aware of various polymer materials that could provide the desired elastic properties required to achieve compression and recovery without excessive hysteresis losses. Thermoplastic polymers that can function like elastomers are generally referred to as plastomers. In the present context, reference to plastomer material is intended to include all thermoplastic elastomers that are elastic at ambient temperature and become plastically deformable at elevated temperatures, such that they can be processed as a melt and be extruded, or injection moulded.

The plastomer spring can be formed by injection moulding and according to a particularly significant aspect, the spring may be integrally formed with additional elements, e.g., those required for its function as part of a fluid pump. In particular, the first and second end portions may be formed to interact with other components of the pump to maintain the spring in position. In one embodiment, they may form cylindrical or part-cylindrical plugs. The first and second end portions may also be formed with passages or channels to allow fluid to flow along the spring past or through these respective portions.

In one embodiment, the spring may further include an integrally formed second valve element. The integrally formed second valve element may be identical to the first valve element or otherwise. In one embodiment the second valve element may include a circumferential skirt formed on the second end portion, projecting outwardly and extending away from the first end portion. The second valve element may surround the second end portion or extend axially beyond the second end portion. In one embodiment, the second valve element may be conical or frusto-conical, widening in a direction away from the first end portion. The integration of one or more valve elements with the spring reduces the number of components that must be manufactured and also simplifies the assembly operations. Given that these components are of the same material, their disposal may also be a single operation.

The fluid pump may include a pump body having an elongate pump chamber surrounding the spring and extending from a pump inlet adjacent to the first end portion to a pump outlet adjacent to the second end portion. As indicated above, the pump chamber may be cylindrical, and the spring may also have an exterior profile that is cylindrical in order to match and fit the pump chamber. The spring may have an external cross-sectional shape that corresponds to an internal cross-section of the pump chamber. In one embodiment, the pump chamber is cylindrical, and the spring defines a generally cylindrical envelope in this region.

As indicated above, the material for the pump body and/or the spring may be a plastomer. A plastomer may be defined by its properties, such as the Shore hardness, the brittleness temperature and Vicat softening temperature, the flexural modulus, the ultimate tensile strength and the melt index. Depending on, for example, the type of fluid to be dispensed, and the size and geometry of the pump body or spring, the plastomer material used in the pump may vary from a soft to a hard material. The plastomer material forming at least the spring may thus have a shore hardness of from 50 Shore A (ISO 868, measured at 23 degrees C.) to 70 Shore D (ISO 868, measured at 23 degrees C.). Optimal results may be obtained using a plastomer material having a shore A hardness of 70-95 or a shore D hardness of 20-50, e.g., a shore A hardness of 75-90. Furthermore, the plastomer material may have brittleness temperature (ASTM D476) lower than −50 degrees Celsius, e.g., from −90 to −60 degrees C., and a Vicat softening temperature (ISO 306/SA) of 30-90 degrees Celsius, e.g., 40-80 degrees C. The plastomers may additionally have a flexural modulus in the range of 15-40 MPa, 20-30 MPa, or 25-27 MPa (ASTM D-790). Likewise, the plastomers may have an ultimate tensile strength in the range of 3-10 MPa, or 5-8 MPa (ASTM D-638). Additionally, the melt flow index may be at least 10 dg/min, or in the range of 20-50 dg/min (ISO standard 1133-1, measured at 190 degrees C.).

Suitable plastomers include natural and/or synthetic polymers. Particularly suitable plastomers include styrenic block copolymers, polyolefins, elastomeric alloys, thermoplastic polyurethanes, thermoplastic copolyesters and thermoplastic polyamides. In the case of polyolefins, the polyolefin can be used as a blend of at least two distinct polyolefins and/or as a co-polymer of at least two distinct monomers. In one embodiment, plastomers from the group of thermoplastic polyolefin blends are used, or in some cases from the group of polyolefin copolymers. A particular group of plastomers is the group of ethylene alpha olefin copolymers. Amongst these, ethylene 1-octene copolymers have been shown to be particularly suitable, especially those having the properties as defined above. Suitable plastomers are available from ExxonMobil Chemical Co. as well as Dow Chemical Co.

It will be understood that the spring may be incorporated into the pump in a number of different ways to assist in the pumping action. In a particular embodiment, the pump chamber may be compressible together with the spring in the axial direction. This may be achieved by providing the pump chamber with a flexible wall that distorts during compression of the pump chamber, e.g., in the form of a bellows or a stretchable tube. In one embodiment, the flexible wall may invert or roll-up as the spring compresses. The overall spring constant of the pump will then be the combined effect of the spring and the pump chamber. The spring may provide support to the pump chamber during its distortion. In this context, support is intended to denote that it prevents the pump chamber from distorting uncontrollably to a position in which it might not be able to restore itself. It may also assist in controlling the distortion to ensure a more constant recovery during the return stroke. It is noted that the pump body or the pump chamber may also provide support to the spring in order to allow it to compress axially in the desired manner.

In order for the spring and pump body to operate effectively together, the first and second end portions may engage with the pump inlet and pump outlet respectively, to retain such engagement during compression of the pump chamber.

To this effect, the end portions may be in the form of plugs as described above that closely fit into cylindrical recesses in the inlet and outlet respectively, while allowing passages for fluid to pass by.

According to one embodiment, the spring and the pump body may be injection moulded of the same material. This is especially advantageous from the perspective of recycling and reduces the material streams during manufacture.

Still more advantageously, because of the efficient design described above, the whole construction of the fluid pump may be achieved using just two components, namely the pump body and the spring, whereby the spring includes a one-way inlet valve and the pump body and the spring interact to define a one-way outlet valve. As will be further described below, the moveable valve element is retained within the valve chamber and seals against the valve seat to form the inlet valve while the second valve element may engage against a wall of the pump outlet to form the outlet valve.

In a particular embodiment, the valve chamber includes a lid as described above and hereinafter and the pump body engages and retains the lid. The lid may define an opening to the valve chamber and the retention of the lid by the pump body may be a sealing connection such that no flow can pass around the lid, i.e., between the lid and the pump body. Additionally or alternatively, the lid may seal to the valve support element defining the pump chamber. The pump body may serve to mechanically engage the lid against the valve support element. In one embodiment, the pump body has an annular groove and the valve support element has a ring element that engages with the annular groove. The lid may also be engaged in such an annular groove, e.g., together with the ring element.

Various manufacturing procedures may be used to form the pump including blow moulding, thermoforming, 3D-printing and other methods. Some or all of the elements forming the pump may be manufactured by injection moulding. In a particular embodiment, the pump body and the spring are each formed by injection moulding. The pump body and the spring may both be of the same material or each may be optimised independently using different materials. As described above, the material may be optimised for its plastomer qualities and also for its suitability for injection moulding. Additionally, although in one embodiment, the spring is manufactured of a single material, it is not excluded that it may be manufactured of multiple materials.

In the case that the spring is integrally formed to include inlet and outlet valves, the designer is faced with two conflicting requirements, to a large degree depending on the fluid that will be pumped:

1. The valves shall be flexible enough to allow for a good seal;
2. The spring shall be stiff enough to provide the required spring constant to pump the fluid.

The disclosure further relates to a pump assembly including a pump as described above, and a pair of sleeves, arranged to slidably interact to guide the pump during a pumping stroke, including a stationary sleeve engaged with the pump inlet and a sliding sleeve engaged with the pump outlet. The stationary sleeve and sliding sleeve may have mutually interacting detent surfaces that prevent their separation and define the pumping stroke. Furthermore, the stationary sleeve may include a socket having an axially extending male portion and the pump inlet has an outer diameter, dimensioned to engage within the socket and includes a boot portion, rolled over on itself to receive the male portion.

Moreover, the disclosure relates to a disposable fluid dispensing package, including a pump as described above or a pump assembly as earlier described, sealingly connected to a collapsible product container.

The disclosure also relates to a method of dispensing a fluid from a fluid pump as described above or hereinafter by exerting an axial force on the pump body between the pump inlet and the pump outlet to cause axial compression of the spring and a reduction in volume of the pump chamber.

The disclosure further provides for an integrally formed valve comprising a captive valve element as described above or further described hereunder. The integrally formed valve comprises a valve support element and a lid, integrally connected together by a living hinge and together forming a valve chamber, the lid comprising an inlet opening to the valve chamber. The valve further comprises a valve element having a biasing spring, integrally formed together with the valve support element, the biasing spring acting to bias the valve element against a valve seat formed around the inlet opening.

BRIEF DESCRIPTION OF THE DRAWINGS

The features and advantages of the present disclosure will be appreciated upon reference to the following drawings of a number of exemplary embodiments, in which.

DETAILED DESCRIPTION OF THE INVENTION

Figure 1:
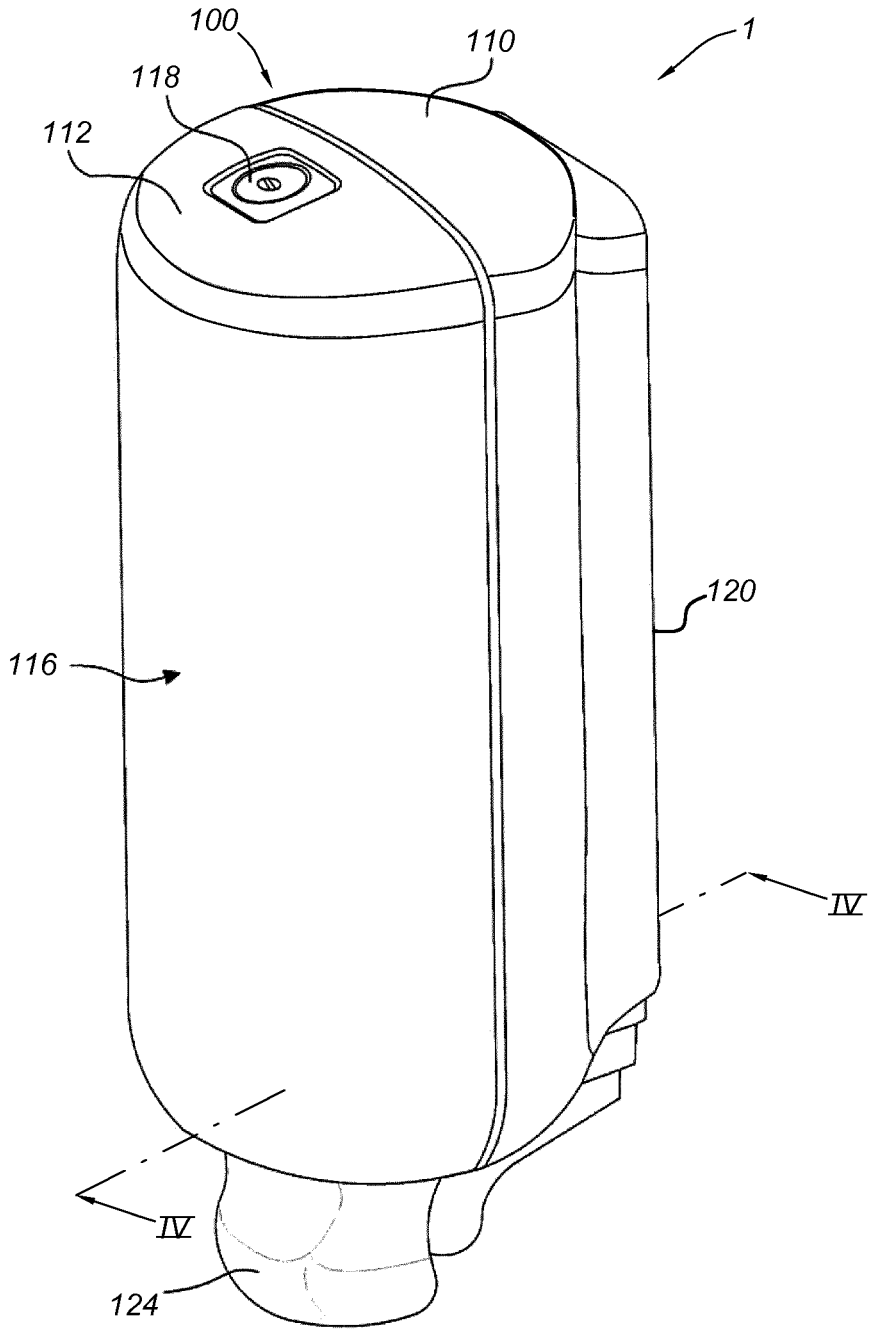
FIG. 1 shows a perspective view of a dispensing system.

FIG. 1 shows a perspective view of a dispensing system 1 in which the present disclosure may be implemented. The dispensing system 1 includes a reusable dispenser 100 of the type used in washrooms and the like available under the name Tork™ from SCA HYGIENE PRODUCTS AB. The dispenser 100 is described in greater detail in WO2011/133085, the contents of which are incorporated herein by reference in their entirety. It will be understood that this embodiment is merely exemplary and that the present invention may also be implemented in other dispensing systems.

The dispenser 100 includes a rear shell 110 and a front shell 112 that engage together to form a closed housing 116 that can be secured using a lock 118. The housing 116 is affixed to a wall or other surface by a bracket portion 120. At a lower side of the housing 116 is an actuator 124, by which the dispensing system 1 may be manually operated to dispense a dose of cleaning fluid or the like. The operation, as will be further described below, is described in the context of a manual actuator but the invention is equally applicable to automatic actuation, e.g., using a motor and sensor.

Figure 2:
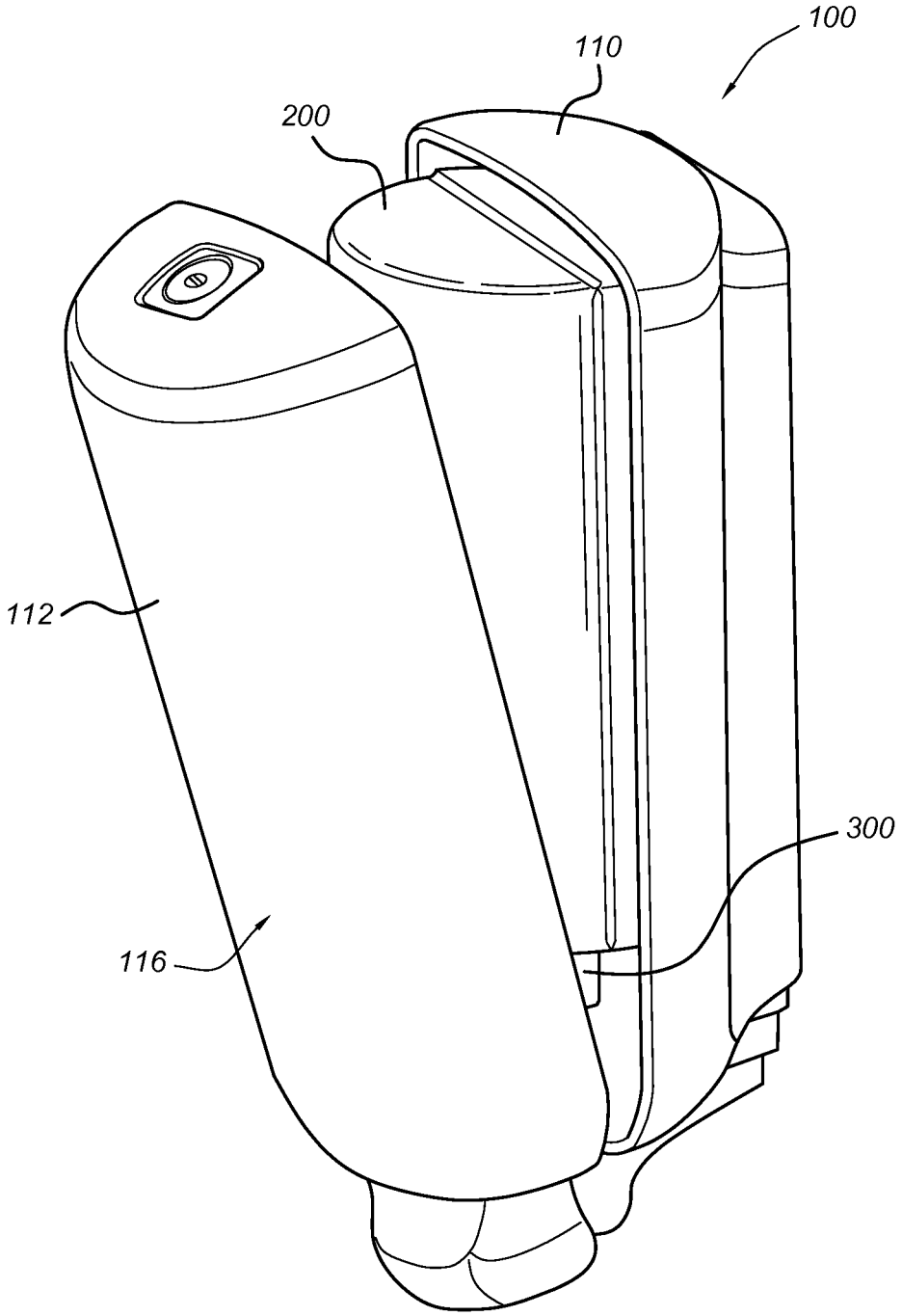
FIG. 2 shows the dispensing system of FIG. 1 in an open configuration.

FIG. 2 shows in perspective view the dispenser 100 with the housing 116 in the open configuration and with a disposable container 200 and pump assembly 300 contained therein. The container 200 is a 1000 ml collapsible container of the type described in WO2011/133085 and also in WO2009/104992, the contents of which are also incorporated herein by reference in their entirety. The container 200 is of generally cylindrical form and is made of polyethylene. The skilled person will understand that other volumes, shapes and materials are equally applicable and that the container 200 may be adapted according to the shape of the dispenser 100 and according to the fluid to be dispensed.

The pump assembly 300 has an outer configuration that corresponds substantially to that described in WO2011/133085. This allows the pump assembly 300 to be used interchangeably with existing dispensers 100. Nevertheless, the interior configuration of the pump assembly 300 is distinct from both the pump of WO2011/133085 and that of WO2009/104992, as will be further described below.

Figure 3:
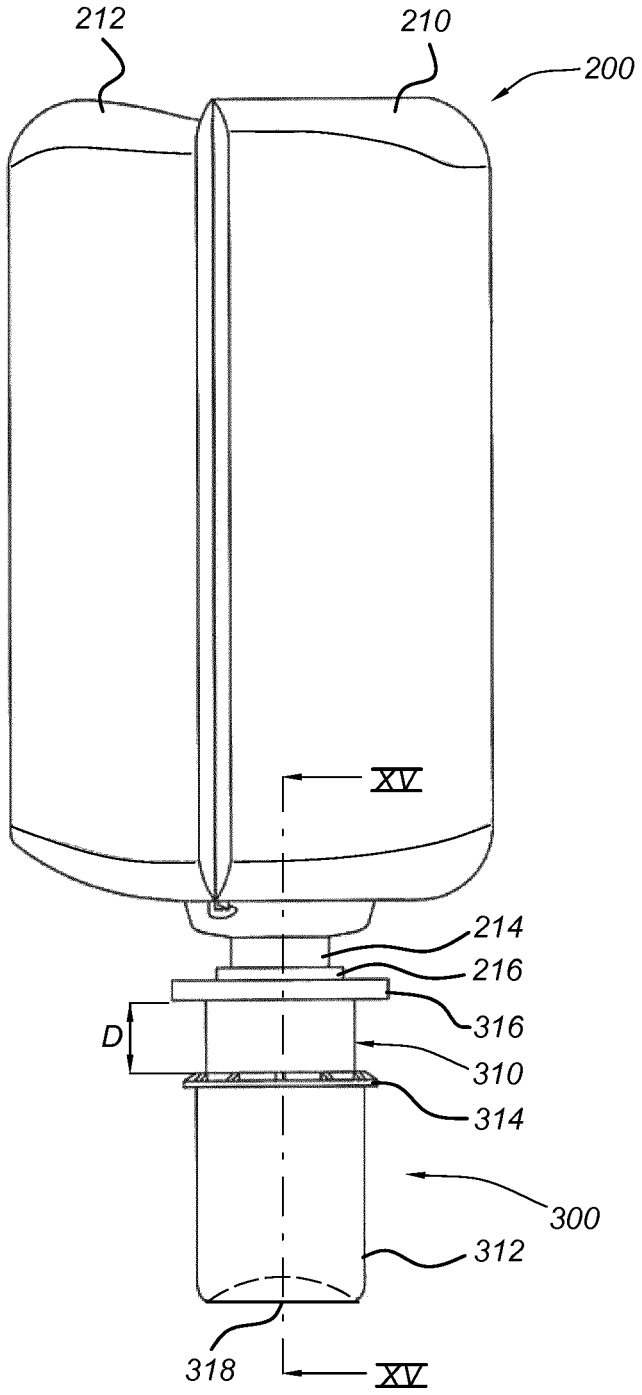
FIG. 3 shows a disposable container and pump assembly in side view.

FIG. 3 shows the disposable container 200 and pump assembly 300 in side view. As can be seen, the container 200 includes two portions. A hard, rear portion 210 and a soft, front portion 212. Both portions 210, 212 are made of the same material but having different thicknesses. As the container 200 empties, the front portion 210 collapses into the rear portion as liquid is dispensed by the pump assembly 300. This construction avoids the problem with a build-up of vacuum within the container 200. The skilled person will understand that although this is an example for the form of the container, other types of reservoir may also be used in the context of the present disclosure, including but not limited to bags, pouches, cylinders and the like, both closed and opened to the atmosphere. The container may be filled with soap, detergent, disinfectant, skincare formulation, moisturizers or any other appropriate fluid and even medicaments. In most cases, the fluid will be aqueous, although the skilled person will understand that other substances may be used where appropriate, including oils, solvents, alcohols and the like. Furthermore, although reference will be made in the following to liquids, the dispenser 1 may also dispense fluids such as dispersions, suspensions or particulates.

At the lower side of the container 200, there is provided a rigid neck 214 provided with a connecting flange 216. The connecting flange 216 engages with a stationary sleeve 310 of the pump assembly 300. The pump assembly 300 also includes a sliding sleeve 312, which terminates at an orifice 318. The sliding sleeve 312 carries an actuating flange 314 and the stationary sleeve has a locating flange 316. Both the sleeves 310, 312 are injection moulded of polycarbonate although the skilled person will be well aware that other relatively rigid, mouldable materials may be used. In use, as will be described in further detail below, the sliding sleeve 312 is displaceable by a distance D with respect to the stationary sleeve 310 in order to perform a single pumping action.

Figure 4A:
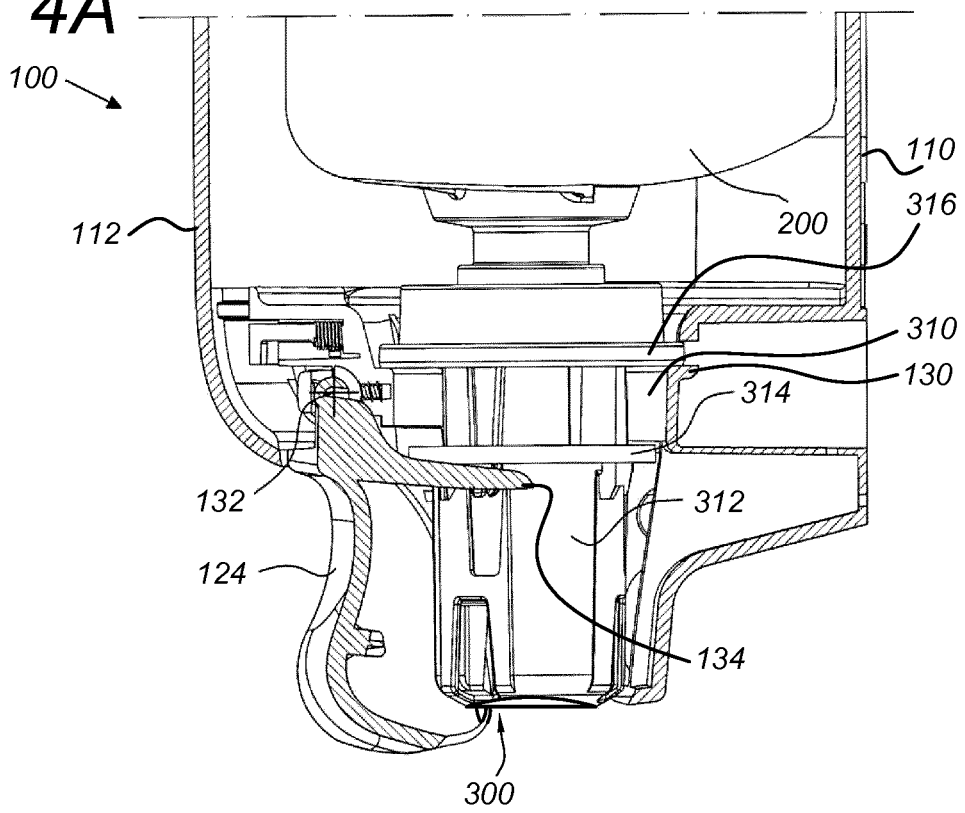
FIGS. 4A and 4B show partial cross-sectional views of the pump of FIG. 1 in operation.
Figure 4B:
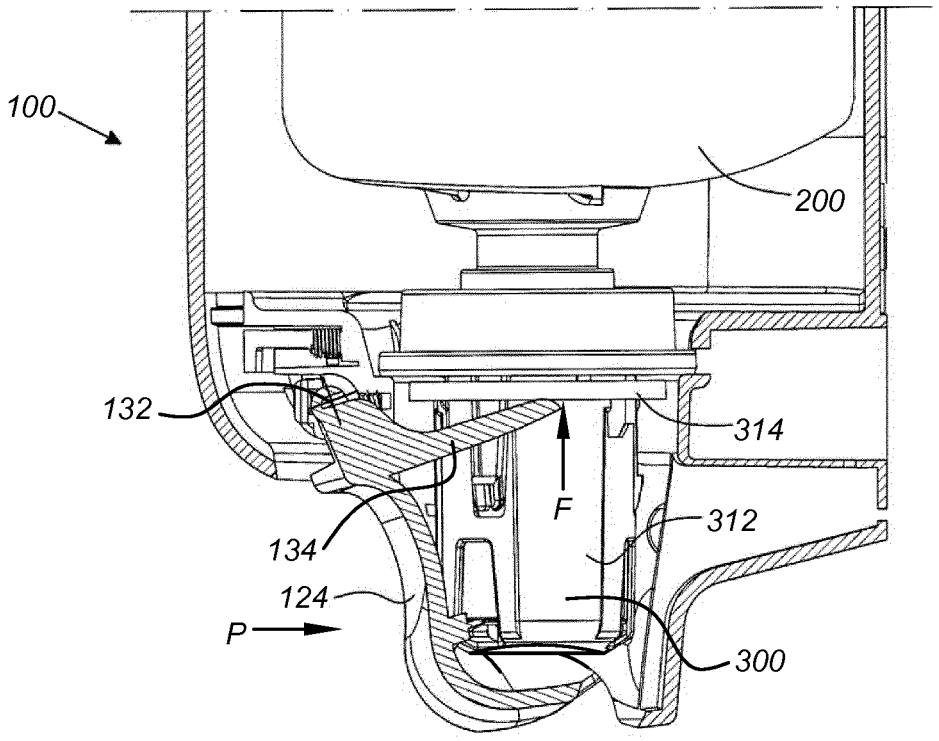

FIGS. 4A and 4B show partial cross-sectional views through the dispenser 100 of FIG. 1, illustrating the pump assembly 300 in operation. According to FIG. 4A, the locating flange 316 is engaged by a locating groove 130 on the rear shell 110. The actuator 124 is pivoted at pivot 132 to the front shell 112 and includes an engagement portion 134 that engages beneath the actuating flange 314.

FIG. 4B shows the position of the pump assembly 300 once a user has exerted a force P on actuator 124. In this view, the actuator 124 has rotated anti-clockwise about the pivot 132, causing the engagement portion 134 to act against the actuating flange 314 with a force F, causing it to move upwards. Thus far, the dispensing system 1 and its operation is essentially the same as that of the existing system known from WO2011/133085.

Figure 5:
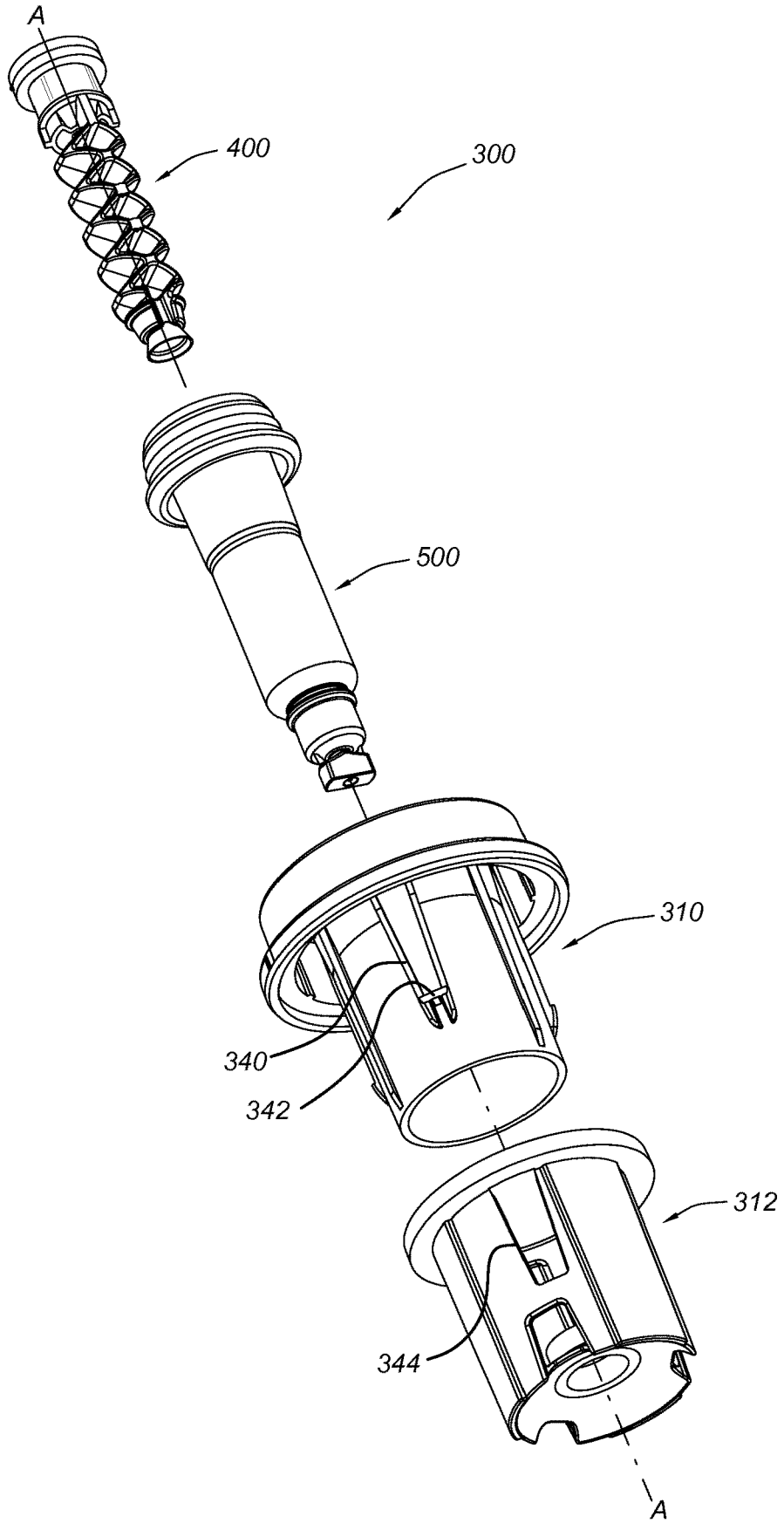
FIG. 5 shows the pump assembly of FIG. 3 in exploded perspective view.

FIG. 5 shows the pump assembly 300 of FIG. 3 in exploded perspective view illustrating the stationary sleeve 310, the sliding sleeve 312, spring 400 and pump body 500 axially aligned along axis A. The stationary sleeve 310 is provided on its outer surface with three axially extending guides 340, each having a detent surface 342. The sliding sleeve 312 is provided with three axially extending slots 344 through its outer surface, the functions of which will be described further below.

Figure 6:
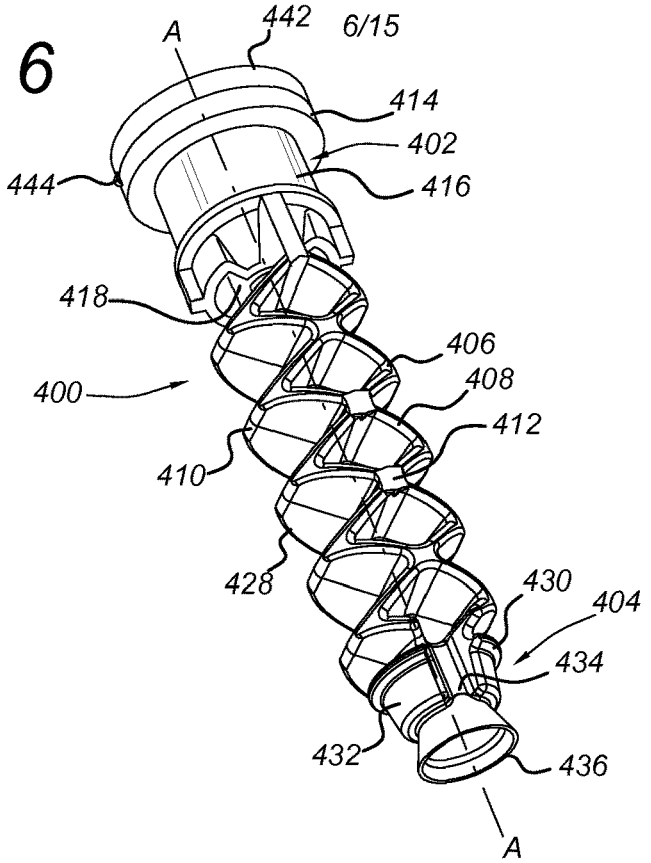
FIG. 6 shows the spring of FIG. 5 in perspective view.

FIG. 6 shows an enlarged perspective view of the spring 400, which is injection moulded in a single piece from ethylene octene material from ExxonMobil Chemical Co. Spring 400 includes a first end portion 402 and a second end portion 404 aligned with each other along the axis A and joined together by a plurality of rhombus shaped spring sections 406. In this embodiment, five spring sections 406 are shown, although the skilled person will understand that more or less such sections may be present according to the spring constant required. Each spring section 406 includes four flat leaves 408, joined together along hinge lines 410 that are parallel to each other and perpendicular to the axis A. The leaves 408 have curved edges 428 and the spring sections 406 join at adjacent corners 412.

The first end portion 402 includes a cylindrical valve support element 416 and a lid 442 connected together by a hinge 444. An outlet opening 418 is formed through the valve support element 416.

The second end portion 404 has a rib 430 and a frusto-conical shaped body 432 that narrows in a direction away from the first end portion 402. On its exterior surface the frusto-conical shaped body 432 is formed with two diametrically opposed flow passages 434. At its extremity, it is provided with an integrally formed second valve element 436 projecting conically outwardly and extending away from the first end portion.

FIGS. 7-10 are respective front cross-section, side and first and second end elevations of the spring 400.

Figure 7:
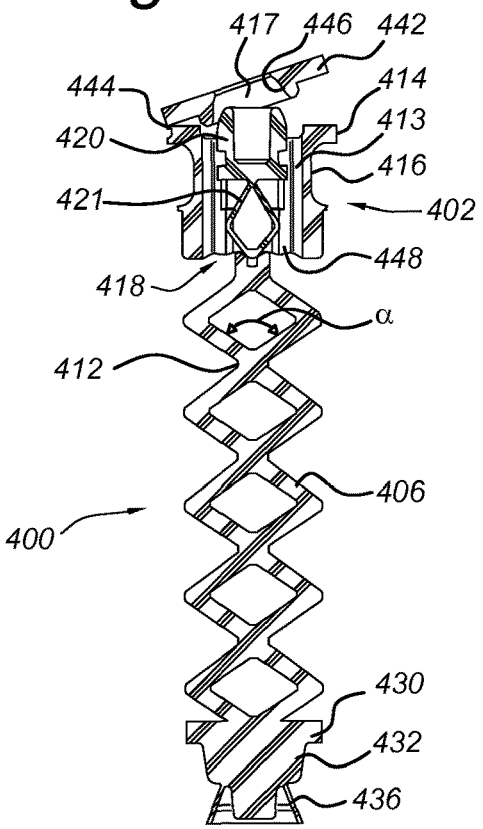
FIG. 7 shows the spring of FIG. 6 in front cross-sectional view.

Starting with FIG. 7, the first end portion 402 is shown in cross-sectional view with the lid 442 partially open. As can be seen, the valve support element 416 is hollow, defining a valve chamber 413 in which is located a first valve element 420 including a biasing spring 421. The valve chamber 413 is closed by the lid 442, which is provided with an inlet opening 417 at its centre. Around the inlet opening 417 is an inlet valve seat 446 against which the first valve element 420 can seal. The cylindrical valve support element 416 extends to a ring element 414, which engages against the lid 442. The lid 442 and the ring element 414 have identical diameters as will be explained further below. Also visible within the valve chamber 413 are splines 448, which extend in the axial direction towards outlet opening 418. The splines 448 are stepped, whereby the first valve element 420 is retained within the valve chamber 413.

In this view according to FIG. 7, the rhombus shape of the spring sections 406 can be clearly seen. The spring 400 is depicted in its unstressed condition and the corners 412 define an internal angle $\alpha$ of around 115°. The skilled person will recognise that this angle may be adjusted to modify the spring properties and may vary from 60 to 160 degrees, from 100 to 130 degrees, or between 90 and 120 degrees. Also visible is the frusto-conical shaped body 432 of the second end portion 404 with rib 430 and second valve element 436.

Figure 8:
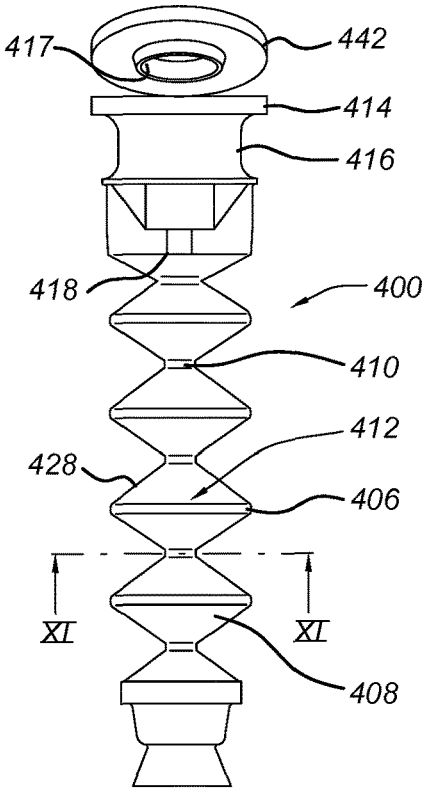
FIG. 8 shows the spring of FIG. 6 in side view.

FIG. 8 depicts the spring 400 in side view, viewed in the plane of the rhombus-shape of the spring sections 406. In this view, the hinge lines 410 can be seen, as can be the curved edges 428. It will be noted that the corners 412, where adjacent spring sections 406 join, are significantly longer than the hinge lines 410 where adjacent flat leaves 408 join.

Figure 9:
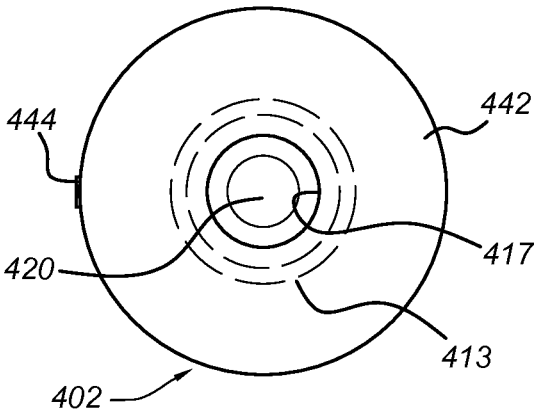
FIG. 9 shows the spring of FIG. 6 in top view.
Figure 10:
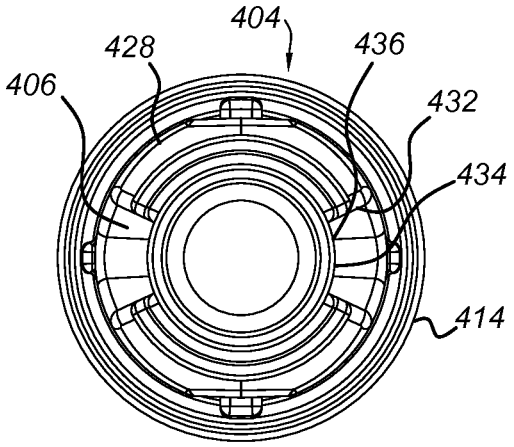
FIG. 10 shows the spring of FIG. 6 in bottom view.

FIG. 9 is a view onto the first end portion 402 showing the lid 442 with the inlet opening 417 and the first valve element 420 within the valve chamber 413. FIG. 10 shows the spring 400 viewed from the opposite end to FIG. 9, with the second valve element 436 at the centre and the frusto-conical shaped body 432 of the second end portion 404 behind it, interrupted by flow passages 434. Behind the second end portion 404, the curved edges 428 of the adjacent spring section 406 can be seen, which in this view define a substantially circular shape. In the shown embodiment, the ring element 414 is the widest portion of the spring 400.

Figure 11:
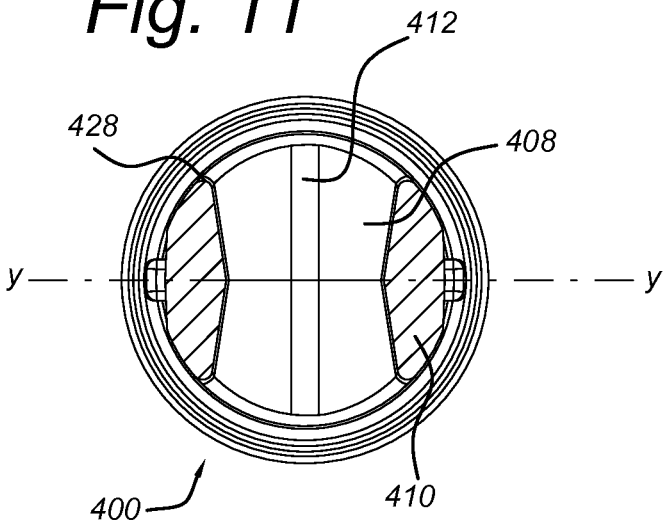
FIG. 11 shows a cross-sectional view through the spring of FIG. 8 along line XI-XI.

FIG. 11 is a cross-sectional view along line XI-XI in FIG. 8 showing the variation in thickness through the flat leaves 408 at the hinge line 410. As can be seen, each leaf 408 is thickest at its mid-line at location Y-Y and is feathered towards the curved edges 428, which are thinner. This tapering shape concentrates the material strength of the spring towards the mid-line and the force about the mid-line and concentrates the force about the axis A.

Figure 12:
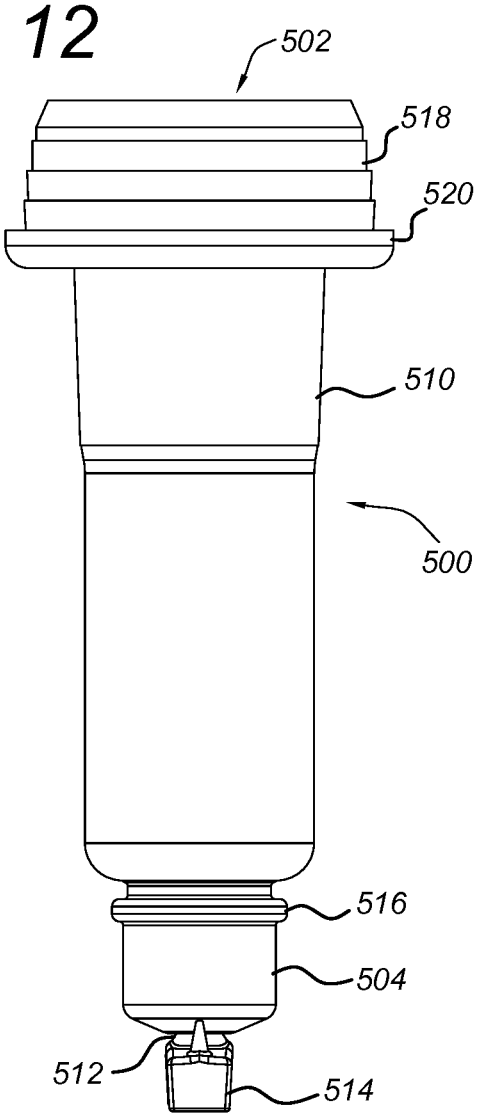
FIG. 12 shows the pump chamber of FIG. 5 in front view.

FIG. 12 shows the pump body 500 of FIG. 5 in front elevation in greater detail. In this embodiment, pump body 500 is also manufactured of the same plastomer material as the spring 400. This is advantageous both in the context of manufacturing and disposal, although the skilled person will understand that different materials may be used for the respective parts. Pump body 500 includes a pump chamber 510, which extends from a pump inlet 502 to a pump outlet 504. The pump outlet 504 is of a smaller diameter than the pump chamber 510 and terminates in a nozzle 512, which is initially closed by a twist-off closure 514. Set back from the nozzle 512 is an annular protrusion 516. The pump inlet 502 includes a boot portion 518 that is rolled over on itself and terminates in a thickened rim 520.

Figure 13:
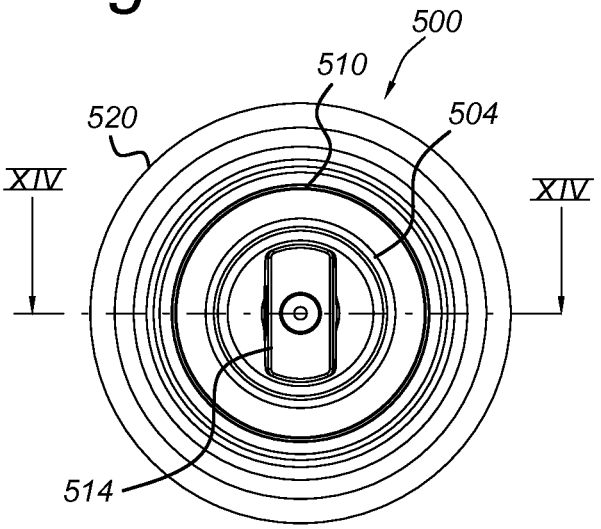
FIG. 13 shows a bottom view of the pump body directed onto the pump outlet.

FIG. 13 shows an end view of the pump body 500 directed onto the pump outlet 504. The pump body 500 is rotationally symmetrical, with the exception of the twist-off closure 514, which is rectangular. The variation in diameter between the pump outlet 504, the pump chamber 510 and the thickened rim 520 can be seen.

Figure 14:
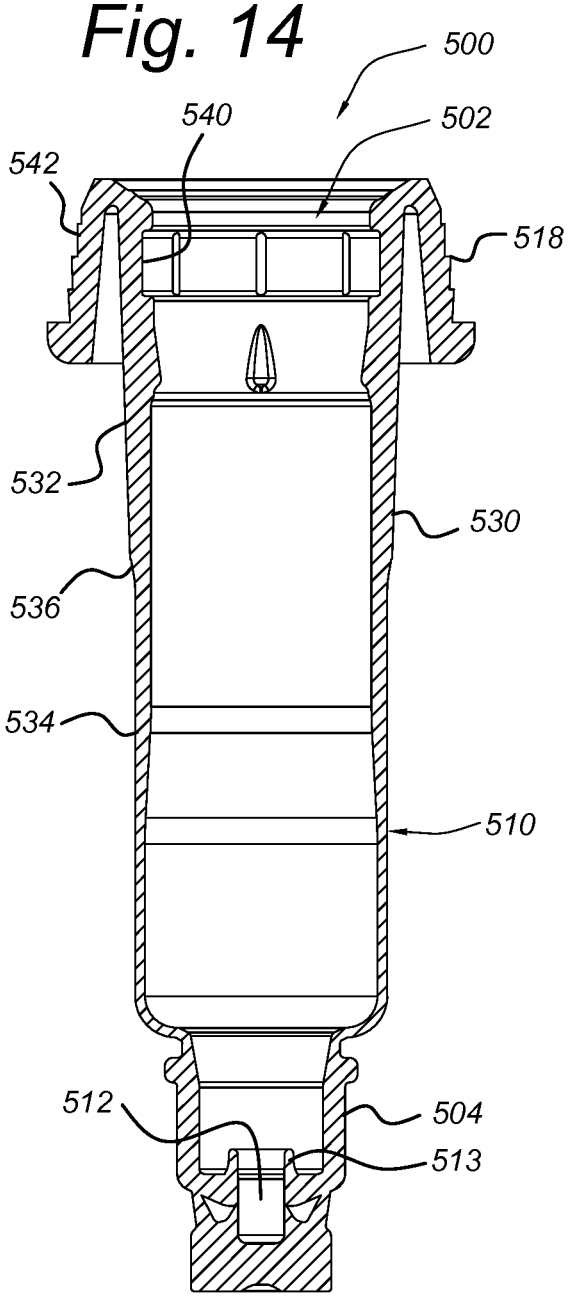
FIG. 14 is a longitudinal cross-sectional view of the pump body taken in direction XIV-XIV in FIG. 13.

FIG. 14 is a longitudinal cross-sectional view of the pump body 500 taken in direction XIV-XIV in FIG. 13. The pump chamber 510 includes a flexible wall 530, having a thick-walled section 532 adjacent to the pump inlet 502 and a thin-walled section 534 adjacent to the pump outlet 504. The thin-walled section 534 and the thick-walled section 532 join at a transition 536. The thin-walled section 534 tapers in thickness from the transition 536 with a decreasing wall thickness towards the pump outlet 504. The thick-walled section 532 tapers in thickness from the transition 536 with an increasing wall thickness towards the pump inlet 502. In addition to the variations in wall thickness of the pump chamber 510, there is also provided an annular groove 540 within the pump body 500 at the pump inlet 502 and sealing ridges 542 on an exterior surface of the boot portion 518. At the pump outlet 504, the nozzle 512 is surrounded by a baffle 513, in the form of an annular protrusion extending axially inwards towards the pump chamber 510.

Figure 15:
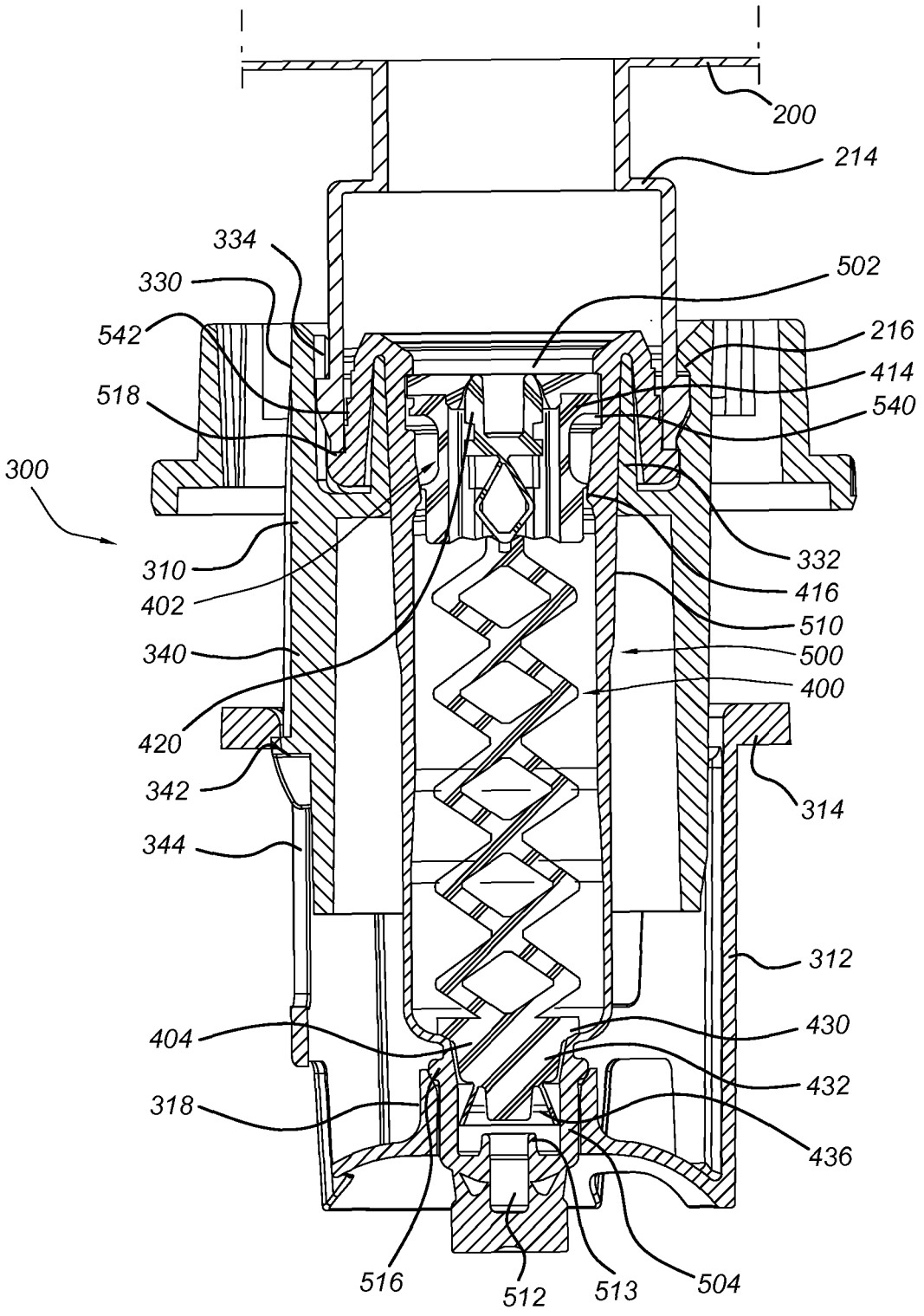
FIGS. 15-18 are cross-sectional views through the pump assembly of FIG. 3 in various stages of operation.

FIG. 15 is a cross-sectional view through the pump assembly 300 of FIG. 3, showing the spring 400, the pump body 500 and the sleeves 310, 312, connected together in a position prior to use. Stationary sleeve 310 includes a socket 330 opening towards its upper side. The socket 330 has an upwardly extending male portion 332 sized to engage within the boot portion 518 of the pump body 500. The socket 330 also includes inwardly directed cams 334 on its inner surface of a size to engage with the connecting flange 216 on the rigid neck 214 of container 200 in a snap connection. The engagement of these three portions results in a fluid tight seal, due to the flexible nature of the material of the pump body 500 being gripped between the relatively more rigid material of the connecting flange 216 and the stationary sleeve 310. Additionally, the sealing ridges 542 on the exterior surface of the boot portion 518 engage within the rigid neck 214 in the manner of a stopper. In the depicted embodiment, this connection is a permanent connection, but it will be understood that other, e.g., releasable connections may be provided between the pump assembly 300 and the container 200.

FIG. 15 also depicts the engagement between the spring 400 and the pump body 500. The inlet portion 402 of the spring 400 is sized to fit within the pump inlet 502 with the ring element 414 and lid 442 together engaged in the groove 540.

At the other end of the pump body 500, the outlet portion 404 engages within the pump outlet 504. The rib 430 has a greater diameter than the pump outlet 504 and serves to position the frusto-conical shaped body 432 and the second valve element 436 within the pump outlet 504. The outside of the pump outlet 504 also engages within the orifice 318 of the sliding sleeve 312 with the nozzle 512 slightly protruding. The annular protrusion 516 is sized to be slightly larger than the orifice 318 and maintains the pump outlet 504 at the correct position within the orifice 318. The second valve element 436 has an outer diameter that is slightly larger than the inner diameter of the pump outlet 504, whereby a slight pre-load is also applied, sufficient to maintain a fluid-tight seal in the absence of any external pressure.

FIG. 15 also shows how the sleeves 310, 312 engage together in operation. The sliding sleeve 312 is slightly larger in diameter than the stationary sleeve 310 and encircles it. The three axial guides 340 on the outer surface of the stationary sleeve 310 engage within respective slots 344 in the sliding sleeve. In the position shown in FIG. 15, the spring 400 is in its initial condition being subject to a slight pre-compression and the detent surfaces 342 engage against the actuating flange 314.

In the position shown in FIG. 15, the container 200 and pump assembly 300 are permanently connected together and are supplied and disposed of as a single disposable unit. The snap connection between socket 330 and the connecting flange 216 on the container 200 prevents the stationary sleeve 310 from being separated from the container 200. The detent surfaces 342 prevent the sliding sleeve 312 from being removed from its position around the stationary sleeve 310 and the pump body 500 and spring 400 are retained within the sleeves 310, 312.

Figure 16:
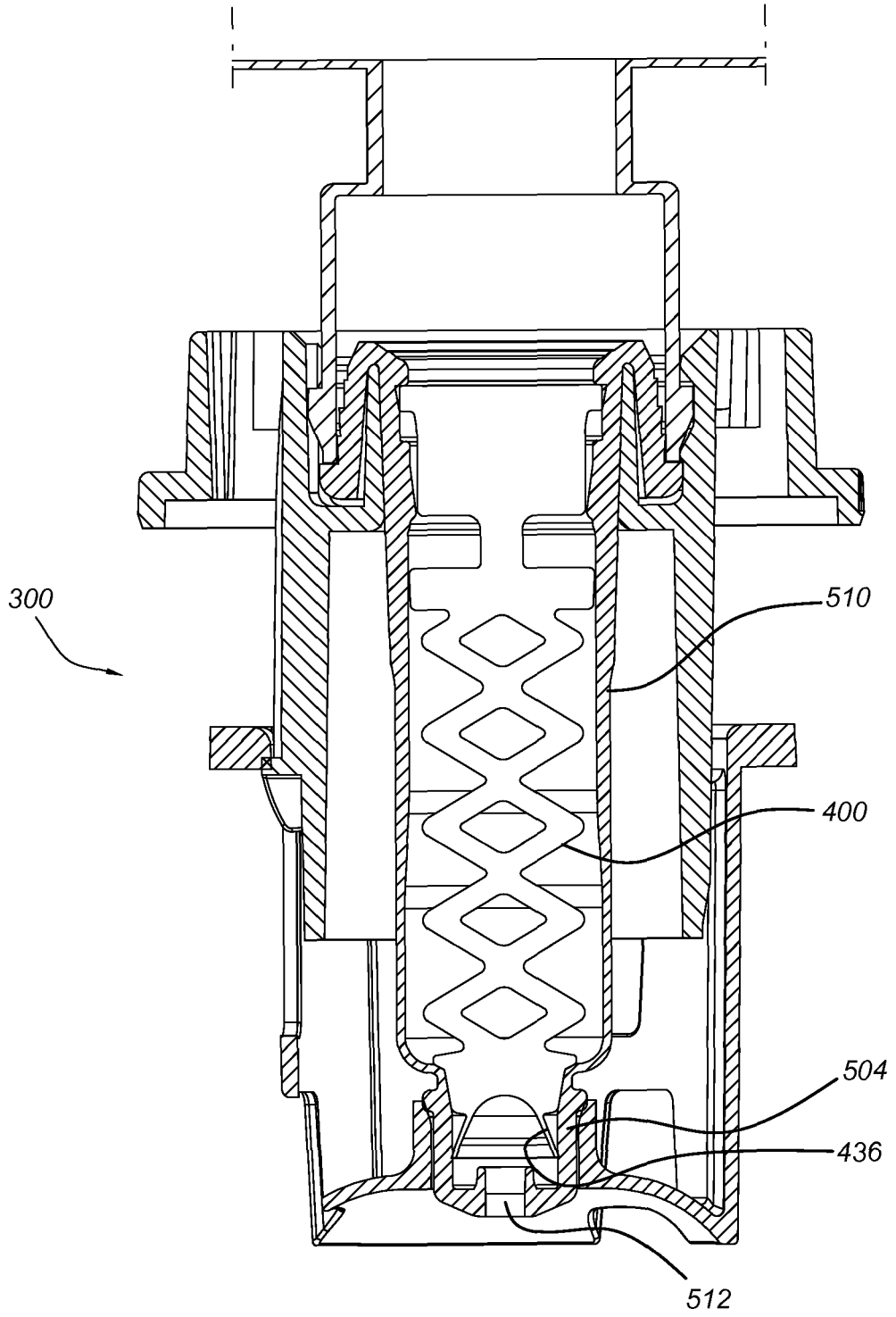

FIG. 16 shows a similar view to FIG. 15 with the twist-off closure 514 removed. The pump assembly 300 is now ready for use and may be installed into a dispenser 100 as shown in FIG. 2. For the sake of the following description, the pump chamber 510 is full of fluid to be dispensed although it will be understood that on first opening of the twist-off closure 514, the pump chamber 510 may be full of air. In this condition, the second valve element 436 seals against the inner diameter of the pump outlet 504, preventing any fluid from exiting through the nozzle 512. The spring 400 is shown only in outline for the sake of clarity.

Figure 17:
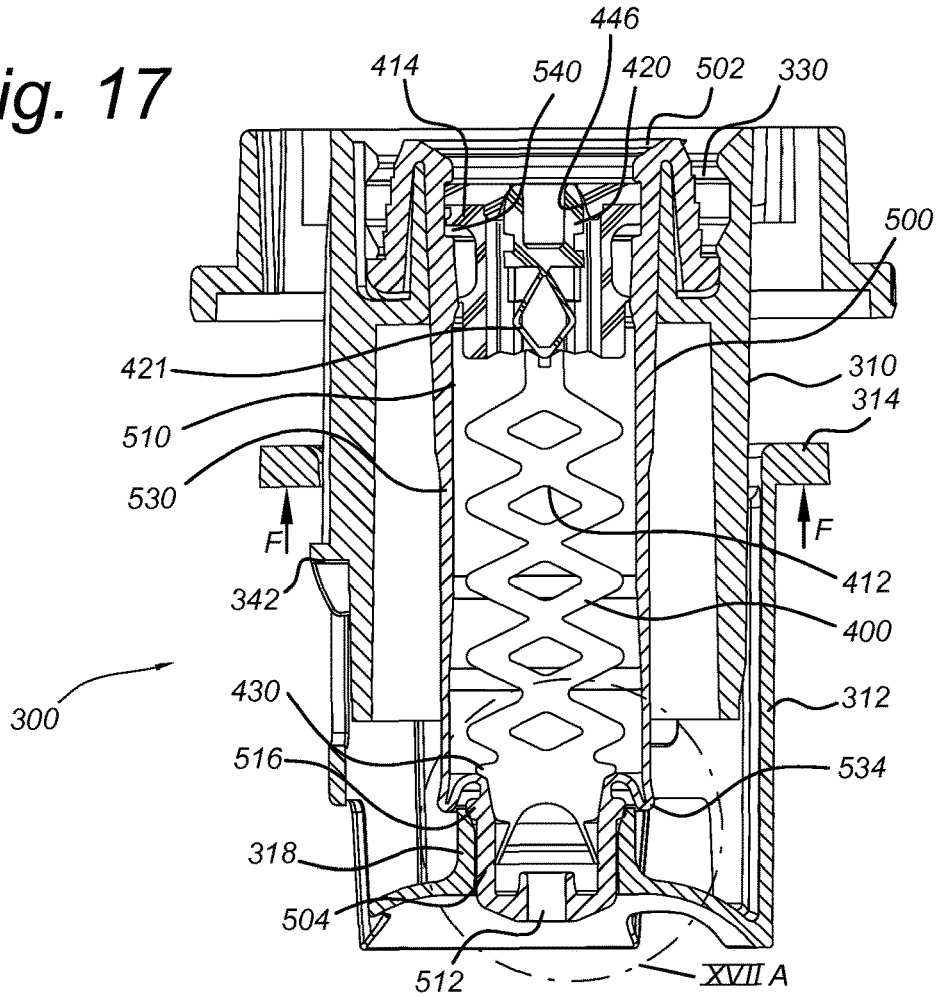

FIG. 17 shows the pump assembly 300 of FIG. 16 as actuation of a dispensing stroke is commenced, corresponding to the action described in relation to FIGS. 4A and 4B. As previously described in relation to those figures, engagement of actuator 124 by a user causes the engagement portion 134 to act against the actuating flange 314 exerting a force F. In this view, the container 200 has been omitted for the sake of clarity.

The force F causes the actuating flange 314 to move out of engagement with the detent surfaces 342 and the sliding sleeve 312 to move upwards with respect to the stationary sleeve 310. This force is also transmitted by the orifice 318 and the annular protrusion 516 to the pump outlet 504, causing this to move upwards together with the sliding sleeve 312. The other end of the pump body 500 is prevented from moving upwards by engagement of the pump inlet 502 with the socket 330 of the stationary sleeve 310.

The movement of the sliding sleeve 312 with respect to the stationary sleeve 310 causes an axial force to be applied to the pump body 500. This force is transmitted through the flexible wall 530 of the pump chamber 510, which initially starts to collapse at its weakest point, namely the thin walled section 534 adjacent to the pump outlet 504. As the pump chamber 510 collapses, its volume is reduced and fluid is ejected through the nozzle 512. Reverse flow of fluid through the pump inlet 502 is prevented by the first valve element 420, which is pressed against the inlet valve seat 446 by the biasing spring 421 and the additional fluid pressure within the pump chamber 510.

Additionally, the force is transmitted through the spring 400 by virtue of the engagement between the rib 430 and the pump outlet 504 and the ring element 414 being engaged in the groove 540 at the pump inlet 502. This causes the spring 400 to compress, whereby the internal angle $\alpha$ at the corners 412 increases.

Figure 17A:
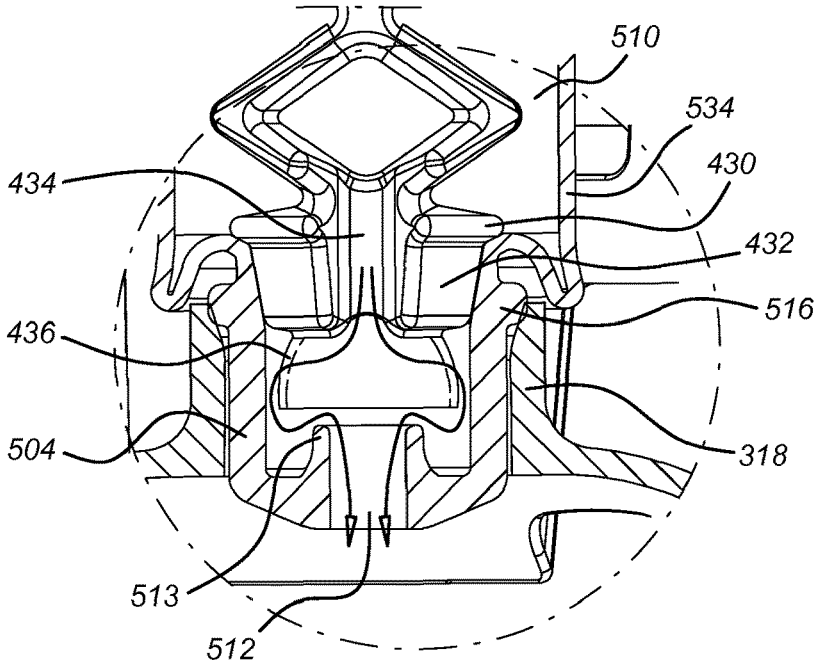
FIG. 17A is a detail in perspective of the pump outlet of FIG. 17.

FIG. 17A is a detail in perspective of the pump outlet 504 of FIG. 17, showing in greater detail how second valve element 436 operates. In this view, spring 400 is shown unsectioned. As can be seen, thin walled section 534 has collapsed by partially inverting on itself adjacent to the annular protrusion 516. Below the annular protrusion 516, the pump outlet 504 has a relatively thicker wall and is supported within the orifice 318, maintaining its form and preventing distortion or collapse. As can also be seen in this view, rib 430 is interrupted at flow passage 434, which extends along the outer surface of the frusto-conical shaped body 432 to the second valve element 436. This flow passage 434 allows fluid to pass from the pump chamber 510 to engage with the second valve element 436 and exert a pressure onto it. The pressure causes the material of the second valve element 436 to flex away from engagement with the inner wall of the pump outlet 504, whereby fluid can pass the second valve element 436 and reach the nozzle 512. The precise manner in which the second valve element 436 collapses, will depend upon the degree and speed of application of the force F and other factors such as the nature of the fluid, the pre-load on the second valve element 436 and its material and dimensions. These may be optimised as required. It may also be noted in this view how baffle 513 deflects the flow within the pump outlet 504. In particular, flow past the second valve element 436 cannot directly enter the nozzle 512 but is deflected axially upwards before reversing towards the nozzle in a concentrated jet. This ensures a more uniform outlet stream from the nozzle 512. In this context, the disclosure also relates to a pump chamber having an outlet valve in the form of an annular skirt and a central outlet nozzle, there being provided a baffle between the outlet valve and the nozzle to deflect a flow of liquid passing the annular skirt in a direction away from the nozzle.

Figure 18:
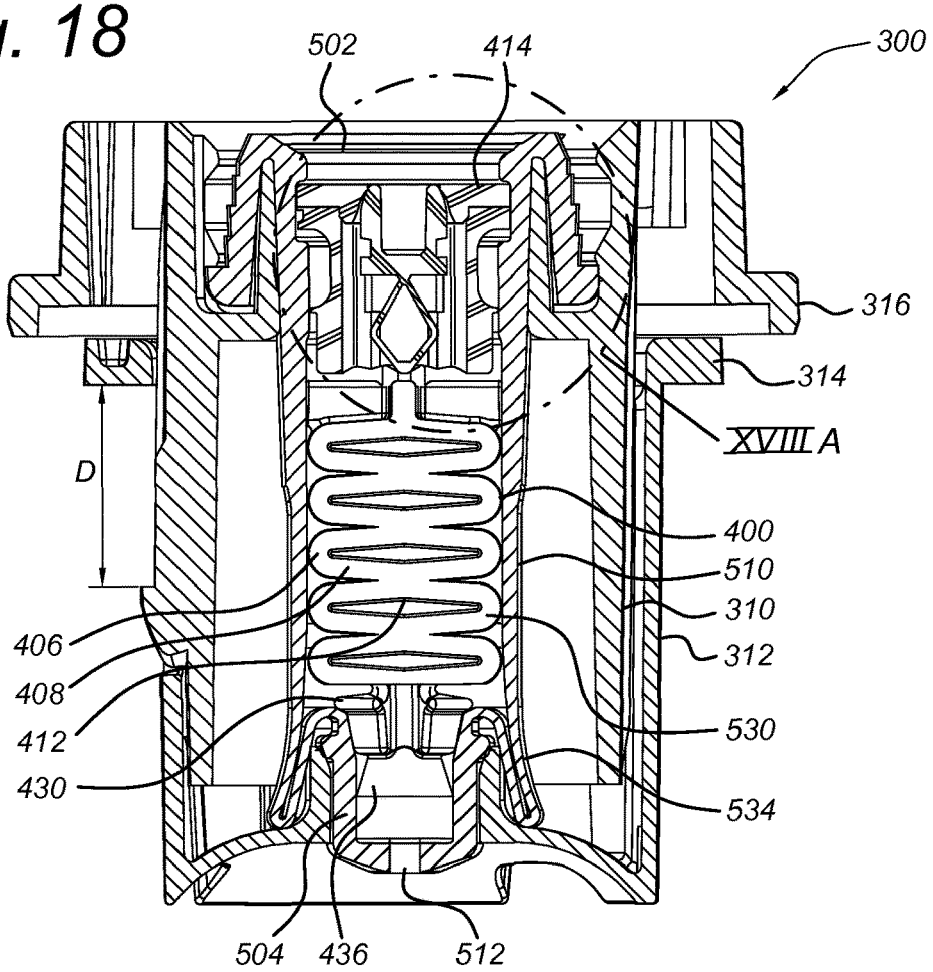

FIG. 18 shows the pump assembly 300 of FIG. 17 in fully compressed state on completion of an actuation stroke. The sliding sleeve 312 has moved upwards a distance D with respect to the initial position of FIG. 16 and the actuating flange 314 has entered into abutment with the locating flange 316. In this position, pump chamber 310 has collapsed to its maximum extent whereby the thin walled section 534 has fully inverted. The spring 400 has also collapsed to its maximum extent with all of the rhombus-shaped spring sections 406 fully collapsed to a substantially flat configuration in which the leaves 408 lie close against each other and, in fact all of the leaves 408 are almost parallel to each other. It will be noted that although reference is given to fully compressed and collapsed conditions, this need not be the case and operation of the pump assembly 300 may take place over just a portion of the full range of movement of the respective components.

As a result of the spring sections 406 collapsing, the internal angle $\alpha$ at the corners 412 approaches 180° and the overall diameter of the spring 400 at this point increases. As illustrated in FIG. 18, the spring 400, which was initially slightly spaced from the flexible wall 530, engages into contact with the pump chamber. At least in the region of the thin walled section 534, the spring sections 406 exert a force on the flexible wall 530, causing it to stretch.

Once the pump has reached the position of FIG. 18, no further compression of the spring 400 takes place and fluid ceases to flow through the nozzle 512. The second valve element 436 closes again into sealing engagement with the pump outlet 504. In the illustrated embodiment, the stroke, defined by distance D is around 10 mm and the volume of fluid dispensed is about 1.1 ml. It will be understood that these distances and volumes can be adjusted according to requirements.

After the user releases the actuator 124 or the force F is otherwise discontinued, the compressed spring 400 will exert a net restoring force on the pump body 500. The spring depicted in the present embodiment exerts an axial force of 20N in its fully compressed condition. This force acts between the ring element 414 and the rib 430 and exerts a restoring force between the pump inlet 502 and the pump outlet 504 to cause the pump chamber 510 to revert to its original condition. The pump body 500 by its engagement with the sleeves 310, 312 also causes these elements to return towards their initial position as shown in FIG. 16.

Figure 18A:
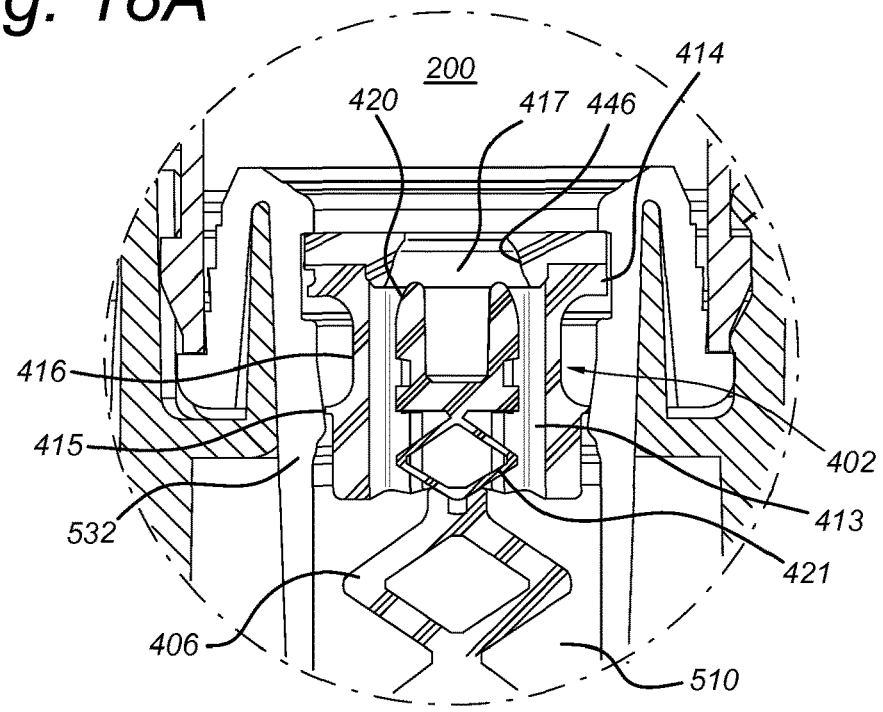
FIG. 18A is a detail in perspective of the pump inlet of FIG. 18 with the inlet valve opened.

As the spring 400 expands, the pump chamber 510 also increases in volume leading to an under pressure within the fluid contained within the pump chamber 510. The second valve element 436 is closed and any under pressure causes the second valve element 436 to engage more securely against the inner surface of the pump outlet 504. FIG. 18A shows in detail the first end portion 402 of the valve 400 during this phase of operation. As the pressure within the pump chamber 510 decreases, the relatively higher pressure within the container 200 causes a net force on the first valve element 420, acting downwards against the bias of the biasing spring 421. The first valve element 420 moves out of engagement with the inlet valve seat 446, allowing fluid to flow into the pump chamber 510 through the valve chamber 413. Also visible in this view is ring seal 415, which engages against the thick-walled section 532 of the pump chamber 510, preventing fluid from passing along the outer surface of the cylindrical valve support element 416.

As the skilled person appreciates, the spring may provide a major restoring force during the return stroke. However, as the spring 400 extends, its force may also be partially augmented by radial pressure acting on it from the flexible wall 530 of the pump chamber 510. The pump chamber 510 may also exert its own restoring force on the sliding sleeve 312 due to the inversion of the thin walled section 534, which attempts to revert to its original shape. Neither the restoring force of the spring 400 nor that of the pump chamber 510 is linear but the two may be adapted together to provide a desirable spring characteristic. In particular, the pump chamber 510 may exert a relatively strong restoring force at the position depicted in FIG. 17, at which the flexible wall 530 just starts to invert. The spring 400 may exert its maximum restoring force when it is fully compressed in the position according to FIG. 18.

The spring 400 of FIGS. 6 to 11 and pump body 500 of FIGS. 12 to 14 are dimensioned for pumping a volume of around 1-2 ml, e.g., around 1.1 ml. In a pump dimensioned for 1.1 ml, the flat leaves 408 have a length of around 7 mm, measured as the distance between hinge lines 410 about which they flex. They have a thickness at their mid-lines of around 1 mm. The overall length of the spring is around 58 mm. The pump body 400 has an overall length of around 70 mm, with the pump chamber 510 being around 40 mm and having an internal diameter of around 15 mm and a minimal wall thickness of around 0.5 mm. The skilled person will understand that these dimensions are merely examples.

The pump/spring may develop a maximum resistance of between 1 N and 50 N, or between 20 N and 25 N on compression. Furthermore, the pump/spring bias on the reverse stroke for an empty pump may be between 1 N and 50 N, between 1 N and 30 N, between 5 N and 20 N, or between 10 N and 15 N. In general, the compression and bias forces may depend on and be proportional to the intended volume of the pump. The values given above may be appropriate for a 1 ml pump stroke.

Figure 19:
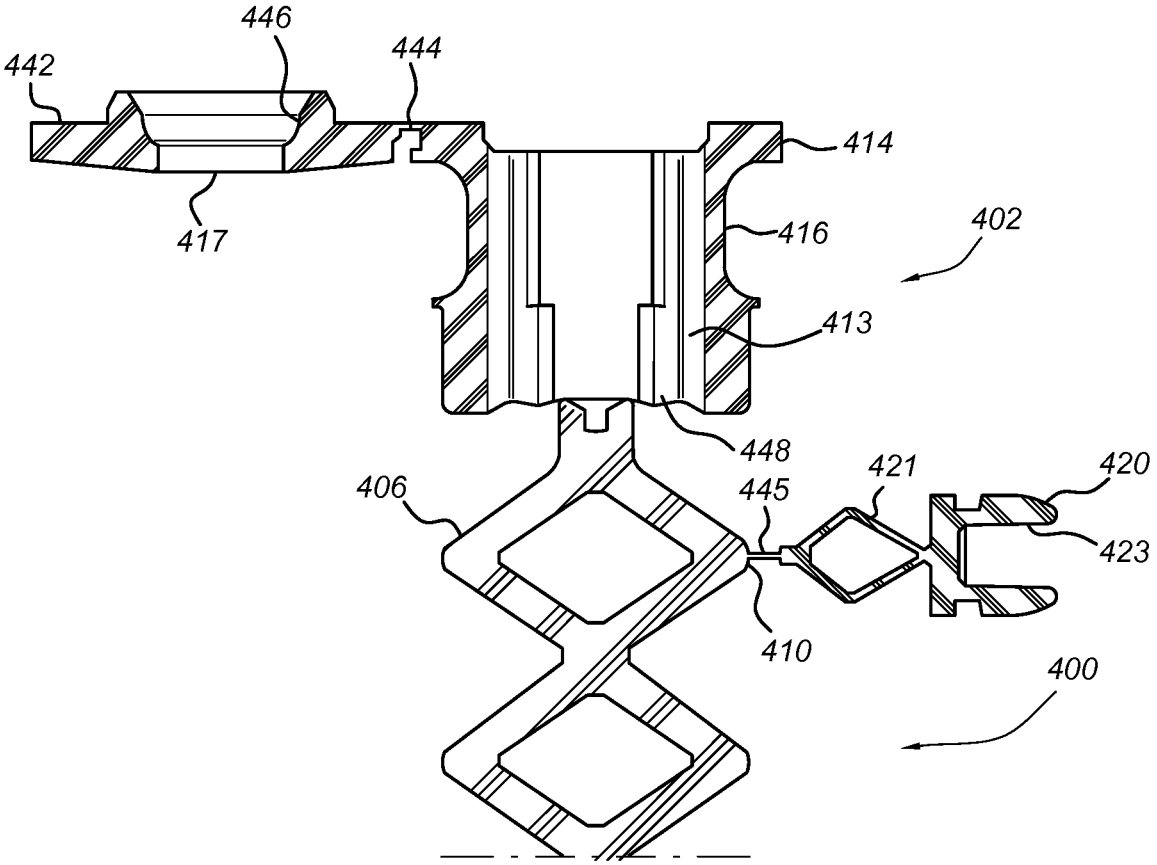
FIG. 19 is a detail of the first end portion of the spring of FIG. 6, as moulded.

FIG. 19 shows an enlarged view of the first end portion 402 of the spring 400 of FIG. 6, in cross-sectional view as manufactured in one embodiment. As can be seen, the lid 442 is attached to the valve support element 416 by hinge 444. This allows both components to be integrally moulded together and subsequently hinged closed to form the valve chamber 413. The first valve element 420 and biasing spring 421 are in this case separate from the valve support element 416 and instead are connected to the upper spring section 406 at hinge line 410 by a web 445, that is subsequently broken during assembly. In this view, the construction of the first valve element 420 can also be appreciated, having a generally bullet shape with a bore 423 opening in a direction opposite to the biasing spring 421. The bore 423 limits the material thickness of the first valve element 420 thus reducing possible component distortion during the injection moulding process.

Figure 20:
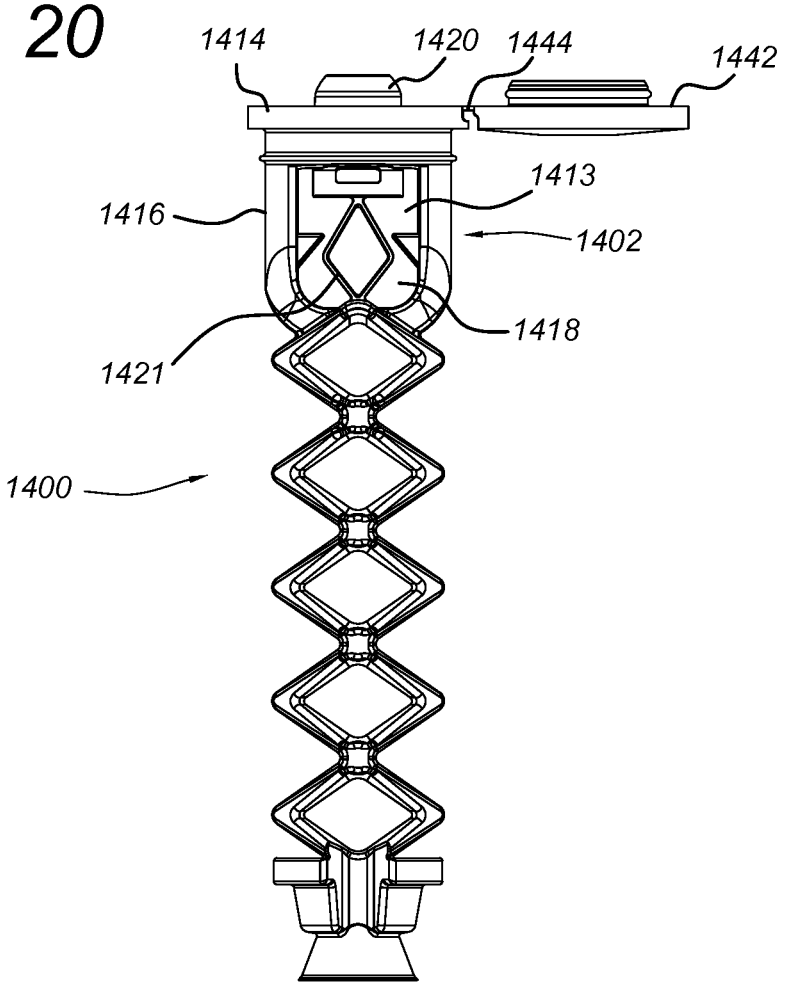
FIG. 20 is a front view of a second embodiment of a spring according to the present disclosure.
Figure 21:
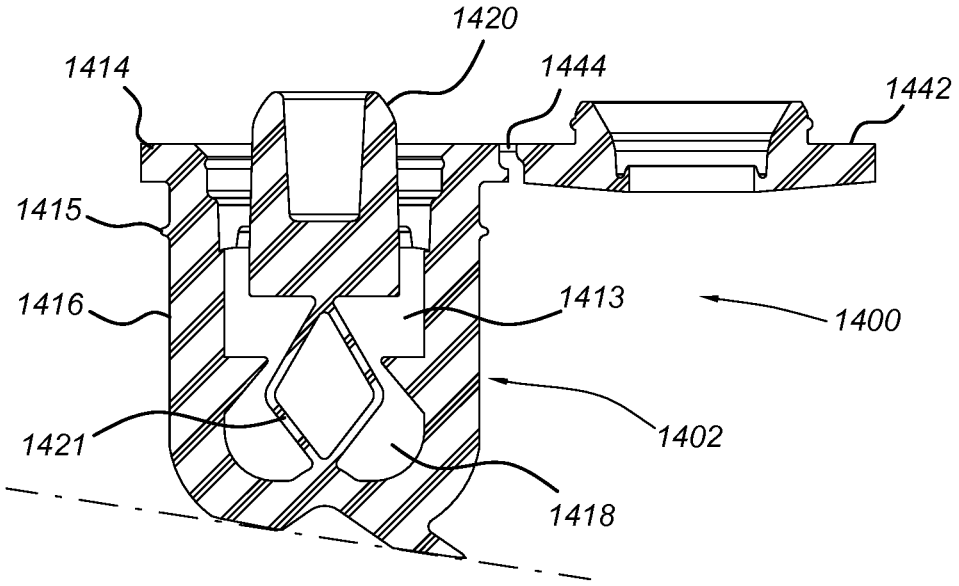
FIG. 21 is a detail of the first end portion of the spring of FIG. 20.

FIGS. 20 and 21 show a second embodiment of a spring 1400, in which like elements to the first embodiment are designated by similar references preceded by 1000. In FIG. 20, the spring is shown in a front elevation corresponding to the view of FIG. 7. The spring 1400 is otherwise identical to the spring 400, with the exception of the construction of the first end portion 1402. As can be seen in this view, the valve chamber 1413 is provided with outlet openings 1418 at front and back sides of a stirrup-shaped valve support element 1416, which terminates at its upper side in ring element 1414. The first valve element 1420 with its biasing spring 1421 can be seen within the valve chamber 1413. As in the first embodiment, the first end portion 1402 includes a lid 1442 connected to the ring element 1414 by a hinge 1444.

FIG. 21 shows the first end portion 1402 of the spring 1400 in enlarged cross sectional view. In this view, it may be appreciated that the biasing spring 1421 is integrally formed with the base of the valve chamber 1413. The outlet openings 1418 and the stirrup shape of the valve support element 1416 allow access of moulding tools to permit injection moulding of the spring 1400 in a single piece with the first valve element 1420 in position and the lid 1442 connected by hinge 1444. During assembly, the lid 1442 merely needs to be closed over the ring element 1414 as the spring 1400 is inserted into the corresponding pump body 500. FIG. 21 also illustrates the ring seal 1415 around the outer circumference of the support element 1416.

Figure 22:
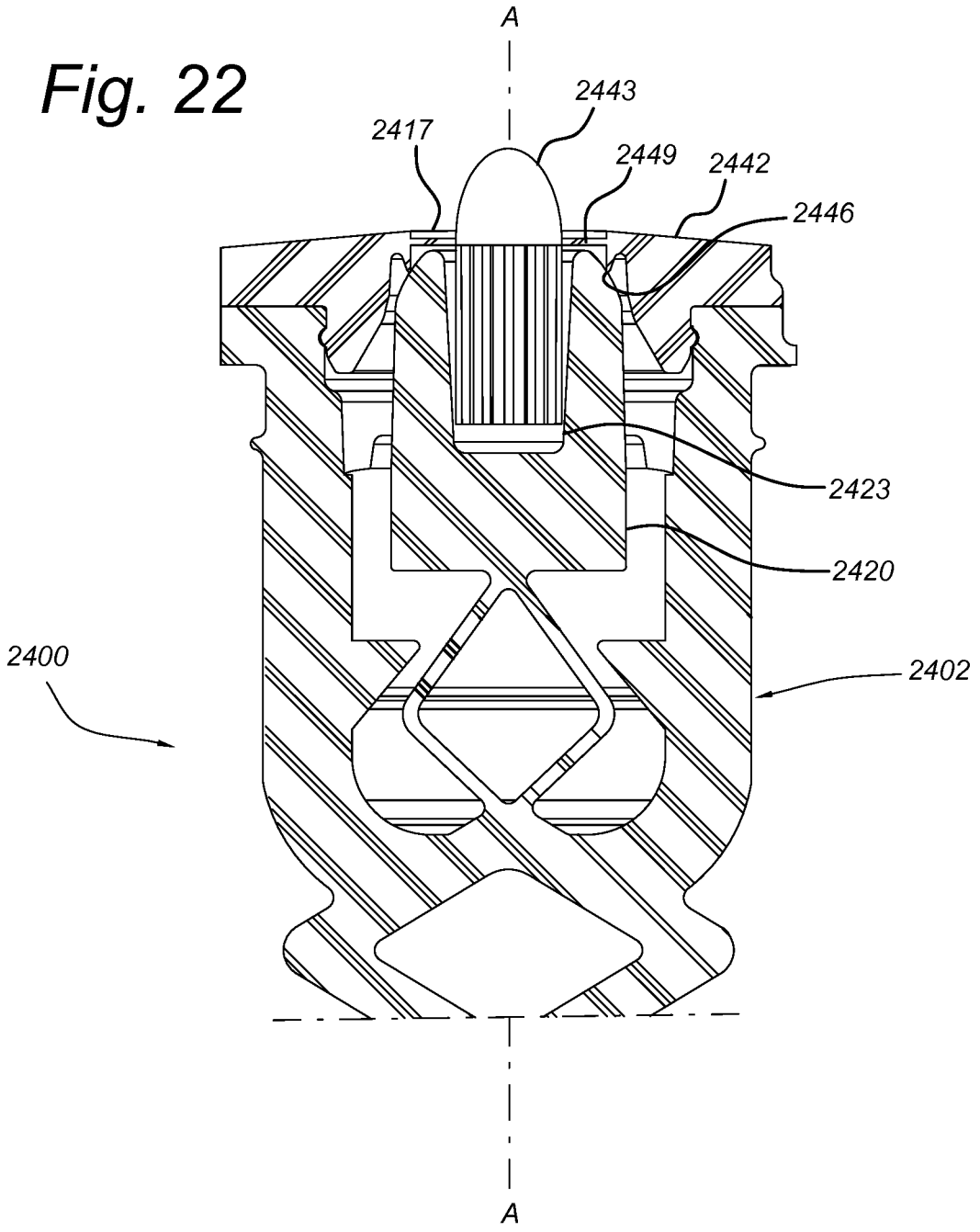
FIG. 22 is a detail of the first end portion of a third embodiment of a spring according to the present disclosure.

FIG. 22 shows a third embodiment of a spring 2400, corresponding closely to the spring 1400 and in which like elements are designated by similar references preceded by 2000. In this embodiment, the first end portion 2402 is shown in cross-section with the lid 2442 closed. Unlike the previous embodiments, the lid 2442 is provided with a central guide 2443 supported within the inlet opening 2417 by struts 2449. The central guide 2443 engages within the bore 2423 of the first valve element 2420 and assists in stabilising the movement of the first valve element 2420 and maintaining it aligned with the axis A. Additionally in this embodiment, the valve seat 2446 is feathered to form a sharp edge for better sealing with, e.g., volatile liquids. It will be understood that such a valve seat may be formed in any of the earlier embodiments too and that the choice of valve seat will be dependent on the particular intended use.

Thus, the present disclosure has been described by reference to the embodiments described above. It will be recognized that these embodiments are susceptible to various modifications and alternative forms well known to those of skill in the art without departing from the spirit and scope of the invention as defined by the appended claims.

What is claimed is:

1. A plastomer spring for use in a fluid pump, comprising:

a first end portion;

a second end portion; and one or more spring sections between and connecting the first end portion to the second end portion and being compressible in an axial direction of the spring from an initial condition to a compressed condition, wherein the first end portion defines a valve chamber for captively receiving a moveable valve element, the valve chamber including a valve seat against which the valve element is configured to seal to prevent fluid flow through the valve chamber, the valve chamber further comprising a valve support element and a lid, arranged to allow positioning of the valve element within the valve chamber during a fabrication process, and further wherein the valve seat is defined around an opening through the lid.

2. The spring according to claim 1, wherein the lid is integrally formed with and hinged to the valve chamber.

3. The spring according to claim 1, further comprising a biasing spring within the valve chamber for biasing the moveable valve element against the seat.

4. The spring according to claim 3, wherein the biasing spring and/or the moveable valve element is integrally formed with the first end portion.

5. The spring according to claim 1, wherein each spring section comprises four flat leaves joined together along hinge lines that are parallel to each other and perpendicular to the axial direction.

6. The spring according to claim 5, wherein the leaves are feathered from a thicker mid-line to thinner edges.

7. The spring according to claim 1, wherein each spring section has curved edges such that the spring has a generally circular configuration, as viewed in the axial direction.

8. The spring according to claim 1, wherein each spring section is arranged to compress from an open configuration to a position in which leaves of each respective spring section lie close against each other.

9. The spring according to claim 1, wherein each spring section can compress axially to less than 60% of an uncompressed length of each spring section.

10. The spring according to claim 1, wherein a plurality of spring sections are joined together in series at adjacent corners and aligned with each other in the axial direction to connect the first end portion to the second end portion.

11. The spring according to claim 10, wherein in the initial condition, the spring sections join at adjacent corners having an internal angle of between 60 to 160 degrees.

12. The spring according to claim 11, comprising at least three spring sections.

13. The spring according to claim 12, wherein the at least three spring sections are identical.

14. The spring according to claim 10, comprising at least three spring sections.

15. The spring according to claim 14, wherein the at least three spring sections are identical.

16. The spring according to claim 1, wherein at least the one or more spring sections comprise a material having a flexural modulus in the range of 15-40 MPa (ASTM D-790).

17. The spring according to claim 1, wherein at least the one or more spring sections comprise a material having an ultimate tensile strength in the range of 3-10 MPa (ASTM D-638).

18. The spring according to claim 1, wherein at least the one or more spring sections comprise a material having a melt flow index of at least 10 dg/min (ISO standard 1133-1).

19. The spring according to claim 1, wherein at least the one or more spring sections comprise an ethylene alpha olefin copolymer.

20. The spring assembly of claim 19, wherein at least one or more of the spring sections comprise ethylene octane.

21. The spring according to claim 1, further comprising an integrally formed second valve element formed as a circumferential element projecting outwardly and a circumferential skirt or truncated cone extending from the second end portion.

22. The spring according to claim 21, wherein the circumferential element projecting outwardly is formed as a planar disk.

23. A pump comprising:

a pump body having an elongate pump chamber; and the spring according to claim 1 located within the pump chamber and extending from a pump inlet adjacent to the first end portion to a pump outlet adjacent to the second end portion.

24. The pump according to claim 23, wherein the pump chamber is compressible together with the spring in the axial direction.

25. The pump according to claim 24, wherein the pump chamber comprises a flexible wall that inverts during compression of the pump chamber.

26. The pump according to claim 23, wherein the first and second end portions engage with the pump inlet and pump outlet respectively, to retain such engagement during compression of the pump chamber.

27. The pump according to claim 23, wherein the pump body and/or the spring are injection moulded of the same material.

28. The pump according to claim 23, wherein the pump body and/or the spring are injection moulded of different materials.

29. The pump according to claim 23, wherein the spring comprises the moveable valve element retained within the valve chamber for allowing fluid flow through the valve chamber in a direction from the first end portion towards the second end portion but preventing flow in the opposite direction.

30. The pump according to claim 23, wherein the pump body and the second end portion interact to define a one-way outlet valve, allowing flow from the first end portion towards the second end portion.

31. The pump according to claim 23, wherein the valve chamber comprises the lid and the pump body engages and retains the lid.

32. A pump assembly comprising the pump according to claim 23, and a pair of sleeves, arranged to slidably interact to guide the pump during a pumping stroke, including a stationary sleeve engaged with the pump inlet and a sliding sleeve engaged with the pump outlet.

33. A disposable fluid dispensing package, comprising the pump assembly according to claim 32 sealingly connected to a collapsible product container.

34. A disposable fluid dispensing package, comprising the pump according to claim 23 sealingly connected to a collapsible product container.

35. A method of dispensing a fluid from a pump according to claim 23, the method comprising exerting an axial force on the pump body between the pump inlet and the pump outlet to cause axial compression of the spring and a reduction in volume of the pump chamber.

36. A dispenser configured to carry out the method according to claim 35 on a disposable fluid dispensing package.

37. A mould for injection moulding and having a shape of the spring according to claim 1.

38. The spring according to claim 1, wherein each spring section can compress axially to less than 50% of an uncompressed length of each spring section.

39. The spring according to claim 1, wherein at least the one or more spring sections comprise a material having a flexural modulus in the range of 20-30 MPa (ASTM D-790).

40. The spring according to claim 1, wherein at least the one or more spring sections comprise a material having a flexural modulus in the range of 25-27 MPa (ASTM D-790).

41. The spring according to claim 1, wherein at least the one or more spring sections comprise a material having an ultimate tensile strength in the range of 5-8 MPa (ASTM D-638).

42. The spring according to claim 1, wherein at least the one or more spring sections comprise a material having a melt flow index of at least 20-50 dg/min (ISO standard 1133-1).

43. An integrally formed valve comprising a valve support element and a lid, integrally connected together by a living hinge and together forming a valve chamber, the lid comprising an inlet opening to the valve chamber, the valve further comprising a valve element having a biasing spring, integrally formed together with the valve support element, the biasing spring acting to bias the valve element against a valve seat formed around the inlet opening.

44. A plastomer spring for use in a fluid pump, comprising:

a first end portion;

a second end portion;

one or more spring sections between and connecting the first end portion to the second end portion and being compressible in an axial direction of the spring from an initial condition to a compressed condition, wherein the first end portion defines a valve chamber for captively receiving a moveable valve element, the valve chamber including a valve seat against which the valve element is configured to seal to prevent fluid flow through the valve chamber, the valve chamber further comprising a valve support element and a lid, arranged to allow positioning of the valve element within the valve chamber during a fabrication process; and a biasing spring within the valve chamber for biasing the moveable valve element against the seat.

45. A pump comprising:

a pump body having an elongate pump chamber; and a spring located within the pump chamber, the spring comprising:

a first end portion;

a second end portion; and one or more spring sections between and connecting the first end portion to the second end portion and being compressible in an axial direction of the spring from an initial condition to a compressed condition, wherein the first end portion defines a valve chamber for captively receiving a moveable valve element, the valve chamber including a valve seat against which the valve element may seal to prevent fluid flow through the valve chamber, the valve chamber further comprising a valve support element and a lid, arranged to allow positioning of the valve element within the valve chamber during a fabrication process, and wherein the spring extends from a pump inlet adjacent to the first end portion to a pump outlet adjacent to the second end portion.

46. A pump assembly comprising the pump according to claim 45, and a pair of sleeves, arranged to slidably interact to guide the pump during a pumping stroke, including a stationary sleeve engaged with the pump inlet and a sliding sleeve engaged with the pump outlet.

47. A disposable fluid dispensing package, comprising the pump assembly according to claim 46 sealingly connected to a collapsible product container.

48. A disposable fluid dispensing package, comprising the pump according to claim 45 sealingly connected to a collapsible product container.

49. A method of dispensing a fluid from a pump according to claim 45, the method comprising exerting an axial force on the pump body between the pump inlet and the pump outlet to cause axial compression of the spring and a reduction in volume of the pump chamber.

* * * * *